US007026994B2

(12) United States Patent
Ikuta et al.

(10) Patent No.: US 7,026,994 B2
(45) Date of Patent: Apr. 11, 2006

(54) SURFACE-MOUNT TYPE ANTENNA AND ANTENNA APPARATUS

(75) Inventors: Takanori Ikuta, Kyoto (JP); Akinori Sato, Kyoto (JP); Kazuo Watada, Kyoto (JP); Shunichi Murakawa, Kyoto (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 10/735,024

(22) Filed: Dec. 12, 2003

(65) Prior Publication Data

US 2004/0125032 A1 Jul. 1, 2004

(30) Foreign Application Priority Data

Dec. 13, 2002 (JP) ..... P2002-362576

(51) Int. Cl.
*H01Q 1/38* (2006.01)
*H01Q 1/24* (2006.01)

(52) U.S. Cl. ..... 343/700 MS; 343/702

(58) Field of Classification Search ..... 343/700 MS, 343/702, 767, 846, 895
See application file for complete search history.

(56) References Cited

U.S. PATENT DOCUMENTS

| | | | | |
|---|---|---|---|---|
| 5,748,149 | A * | 5/1998 | Kawahata | 343/700 MS |
| 5,861,854 | A * | 1/1999 | Kawahata et al. | 343/702 |
| 5,959,582 | A * | 9/1999 | Kawahata et al. | 343/700 MS |
| 6,683,572 | B1 | 1/2004 | Abe et al. | 343/700 MS |
| 6,700,543 | B1 * | 3/2004 | Konishi et al. | 343/700 MS |
| 6,707,427 | B1 * | 3/2004 | Konishi et al. | 343/700 MS |
| 2002/0030626 | A1 * | 3/2002 | Nagumo et al. | 343/700 MS |
| 2003/0006936 | A1 * | 1/2003 | Aoyama et al. | 343/700 MS |

FOREIGN PATENT DOCUMENTS

| | | |
|---|---|---|
| JP | 07-249927 | 9/1995 |
| JP | 09-162633 | 6/1997 |
| JP | 10-173427 | 6/1998 |
| JP | 2002-076756 | 3/2002 |
| JP | 2002-158529 | 5/2002 |
| JP | 2002-232223 | 8/2002 |

* cited by examiner

*Primary Examiner*—Tuyet Vo
*Assistant Examiner*—Emphrem Alemu
(74) *Attorney, Agent, or Firm*—Hogan & Hartson LLP

(57) ABSTRACT

An surface-mount type antenna includes a rectangular parallelepiped base body, a feeding terminal formed at one-end-side part of one side surface thereof, and a radiating electrode, to one end of which is connected the feeding terminal, disposed such that its other end is routed from one-end-side part of one side surface, through one-end-side part of one principal surface, to another-end-side part of one principal surface, and extends from the other-end-side part to the one end side part parallelly with a ridge of the base body, and is eventually formed into an open end. An antenna apparatus is constructed by mounting the surface-mount type antenna on a mounting substrate having a feeding electrode and a ground conductor layer with a linear side edge located near the feeding electrode, with the ridge of the base body arranged parallel to the linear side edge of the ground conductor layer.

11 Claims, 18 Drawing Sheets

FIG. 11

AMOUNT OF VARIATION IN RESONANT FREQUENCY PER UNIT LENGTH OF TRIMMED RADIATING ELECTRODE TERMINATING PORTION

| | RADIATING ELECTRODE ARRANGEMENT | GND DISCONNECTION | GND CONNECTION |
|---|---|---|---|
| 1 | 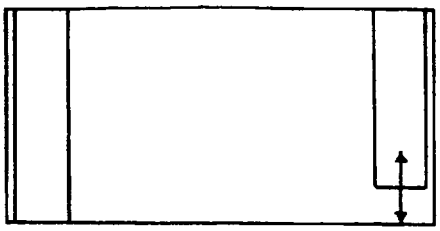 | 19.1 MHz/mm (VARIED GREATLY) | 36.4 MHz/mm (VARIED GREATLY) |
| 2 | 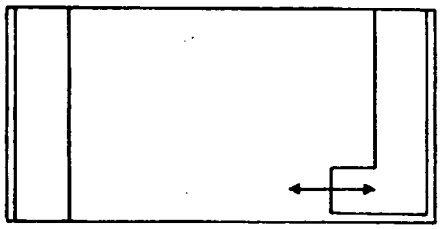 | 13.0 MHz/mm (VARIED SLIGHTLY) | 23.7 MHz/mm (VARIED SLIGHTLY) |
| 3 | 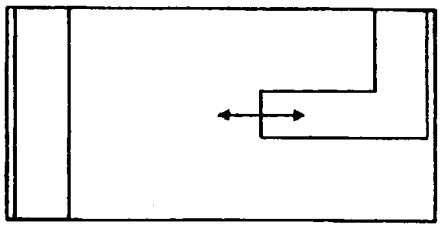 | 10.2 MHz/mm (VARIED SLIGHTLY) | 18.3 MHz/mm (VARIED SLIGHTLY) |
| 4 | 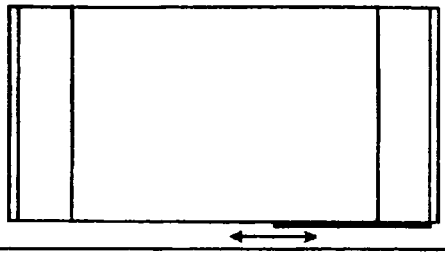 | 9.5 MHz/mm (VARIED SLIGHTLY) | 16.5 MHz/mm (VARIED SLIGHTLY) |

SURFACE-MOUNT TYPE ANTENNA AND ANTENNA APPARATUS

BACKGROUND OF THE INVENTION

1. Field of the Invention

The present invention relates to a surface-mount type antenna which is a compact antenna, and an antenna apparatus for use in mobile communication apparatus such as a cellular phone.

2. Description of the Related Art

Recently, in keeping with rapid advancement of downsized, lightweight, and high-performance mobile communication equipment such as a cellular phone, miniaturization and high performance have come to be increasingly demanded of an antenna which constitutes such equipment. To meet such demands, for example, a surface-mount type antenna has hitherto been developed.

Now, a surface-mount type antenna of conventional design and an antenna apparatus incorporating the antenna will be described with reference to a perspective view shown in FIG. 10.

In FIG. 10, reference numeral 200 represents a surface-mount type antenna. The surface-mount type antenna 200 is mounted on a mounting substrate 210, thus constituting an antenna apparatus 220. In the surface-mount type antenna 200 shown in FIG. 10, reference numeral 201 represents a substantially rectangular parallelepiped base body; reference numeral 202 represents a feeding terminal; reference numeral 206 represents an auxiliary terminal for surface mounting; and reference numerals 203, 204, and 205 each represent a radiating electrode. Strictly speaking, The conductors of the individual radiating electrode portions are conjoined to one another to constitute the radiating electrode. Moreover, in the mounting substrate 210, reference numeral 211 represents a substrate; reference numeral 207 represents a feeding electrode; reference numeral 208 represents an auxiliary electrode for surface mounting; and reference numeral 209 represents a ground conductor layer.

In the conventional surface-mount type antenna 200, the feeding terminal 202 is formed on a side surface a of the base body 201. The radiating electrode 203, 204, 205, which is routed as a long conductor pattern, is configured such that its end extends upwardly from the feeding terminal 202 on the side surface a, is then substantially U-shaped, as viewed plane-wise, on a top surface b of the base body 201, and is eventually formed into an open end. The open end of the radiating electrode 205 extends along the shorter side (the right-hand side of the top surface b of the base body 201 in FIG. 10) of the base body 201.

The open end 205 of the radiating electrode, which extends along the shorter side (the right-hand side of the top surface b of the base body 201 in FIG. 10) of the base body 201, may be cut down for the purpose of adjusting the resonant frequency to a desired level. By making the radiating electrode shorter in this way, the resonant frequency can be increased.

Moreover, in the surface-mount type antenna, to achieve impedance matching between the radiating electrode 203, 204, 205 and the feeding electrode 207, a matching circuit (not shown) is additionally disposed in the feeding electrode 207 of the mounting substrate 210 that is connected to the feeding terminal 202 of the radiating electrode 203, 204, 205.

Meanwhile, in the mounting substrate 210, on the top surface of the substrate 211 are arranged the feeding electrode 207, the auxiliary electrode for surface mounting 208, and the ground conductor layer 209. The ground conductor layer 209 is arranged face to face with one side of the auxiliary electrode for surface mounting 208 and has connection with the auxiliary electrode for surface mounting 208.

Then, the surface-mount type antenna 200 is mounted on the top surface of the mounting substrate 210, with the feeding terminal 202 connected to the feeding electrode 207, and the auxiliary terminal for surface mounting 206 connected to the auxiliary electrode for surface mounting 208. Thereupon, the antenna apparatus 220 is realized.

A related art is disclosed in Japanese Unexamined Patent Publication 2002-158529 (2002).

However, the conventional surface-mount type antenna 200 has the following disadvantage. In the radiating electrode 203, 204, 205, for the purpose of adjusting the resonant frequency to a desired level, the open end 205 of the radiating electrode extending along the shorter side (the right-hand side of the top surface b of the base body 201 in FIG. 10) of the base body 201 of the surface-mount type antenna 200 may be cut down. By making the radiating electrode shorter in this way, the resonant frequency can be increased. In this case, however, the variation of the resonant frequency corresponding to the cut length is so significant that the resonant-frequency adjustment operation becomes difficult. As a result, the desired antenna characteristics as designed cannot be readily attained with stability.

SUMMARY OF THE INVENTION

The invention has been devised in view of the above-described problems with the conventional art, and accordingly its object is to provide a surface-mount type antenna and an antenna apparatus that succeed in readily attaining satisfactory antenna characteristics with stability, in enhancing radiation efficiency, and in achieving miniaturization and cost reduction.

The invention provides a surface-mount type antenna comprising:

a base body made of a rectangular parallelepiped dielectric or magnetic material;

a feeding terminal formed at one end of one side surface of the base body; and a radiating electrode, to one end of which is connected the feeding terminal, disposed such that its other end is routed from one end side part of one side surface, through one end side part of one principal surface of the base body, to another end side part of one principal surface, or another end side part of one side surface, or another end side part of another principal surface, and extends farther from the other end side part to one end side part so as to be parallel to a ridge of the base body, and is eventually formed into an open end.

According to the invention, the surface-mount type antenna includes: the base body made of a rectangular parallelepiped dielectric or magnetic material; the feeding terminal formed at one end of one side surface of the base body; and the radiating electrode. The radiating electrode, to one end of which is connected the feeding terminal, is disposed such that its other end is routed from one end side part of one side surface, through one end side part of one principal surface of the base body, to the other end side part of one principal surface, or the other end side part of one side surface, or the other end side part of the other principal surface, and extends farther from the other end side part to one end side part so as to be parallel to the ridge of the base body, and is eventually formed into an open end. In this construction, the radiating electrode terminating portion is formed as an open end extending in parallel with the ridge of the base body. The mounting substrate has formed thereon the feeding electrode and the ground conductor layer having a linear side edge located in the vicinity of the feeding electrode. The surface-mount type antenna of the invention is mounted on the mounting substrate, with the other principal surface of the base body arranged on the top surface of the mounting substrate, and with the ridge of the base body arranged parallel to the linear side edge of the ground conductor layer. Thereby, the radiating electrode terminating portion of the surface-mount type antenna of the invention is arranged substantially parallel to the linear side edge of the ground conductor layer. Hence, variation in the resonant frequency accompanied by variation in the stray capacitance created between the radiating electrode and the ground conductor layer can be reduced. This is advantageous in terms of fine adjustment of the resonant frequency that is important to achieve satisfactory antenna characteristics. That is, in the case of making adjustment to the length of the radiating electrode terminating portion, the amount of variation in the resonant frequency per unit length can be reduced successfully.

In the invention it is preferable that a through hole or a groove is formed in the base body made of a rectangular parallelepiped dielectric or magnetic material, the through hole being drilled all the way through from one side surface to another side surface, or from one end face to another end face, or from one principal surface to the other principal surface of the base body, and the groove being formed on the other principal surface of the base body so as to penetrate all the way through from one end face to the other end face, or from one side surface to the other side surface.

According to the invention, a through hole or a groove is formed in the base body made of a rectangular parallelepiped dielectric or magnetic material. The through hole is drilled all the way through from one side surface to the other side surface, or from one end face to the other end face, or from one principal surface to the other principal surface of the base body. The groove is formed on the other principal surface of the base body so as to penetrate all the way through from one end face to the other end face, or from one side surface to the other side surface. By creating such a through hole or a groove, the effective relative dielectric constant of the base body can be decreased; wherefore the accumulation of electric field energy can be suppressed. This makes it possible to achieve a wider bandwidth in the first surface-mount type antenna of the invention. Another advantage is that both the amount of the material used to form the base body and the weight of the construction can be reduced successfully.

In the invention it is preferable that an auxiliary terminal for surface mounting is formed on the other principal surface of the base body made of a rectangular parallelepiped dielectric or magnetic material.

According to the invention, the auxiliary terminal for surface mounting is formed on the other principal surface of the surface-mount type antenna of the invention mentioned above. In this case, at the time of mounting the surface-mount type antenna on the mounting substrate, the surface-mount type antenna can be firmly fixed by bonding using a solder such as a brazing filler material, with the aid of the auxiliary electrode for surface mounting disposed on the mounting substrate. This helps prevent the surface-mount type antenna from undergoing positional deviation, and thus the desired antenna characteristics can be maintained satisfactorily.

In the invention it is preferable that the rectangular parallelepiped base body is chamfered at its corner and ridge to produce a curved or flat chamfer.

According to the invention, it is possible to prevent a crack or chipping from occurring in the base body, to ease the mechanical stress occurring in the base body. In addition, it is possible to decrease the possibility of a break in each joint in the radiating electrode located in the ridge portion of the base body.

In the invention, it is preferable that the base body is made of a dielectric material having a relative dielectric constant $\epsilon r$ which is kept within a range from 3 to 30.

According to the invention, an effective length of the radiating electrode is decreased, and thus the current distribution region is increased in area. This allows the radiating electrode to emit a larger quantity of radio waves, resulting in advantages in enhancing a gain of the antenna and in achieving miniaturization of the surface-mount type antenna.

In the invention, it is preferable that the base body is made of a magnetic material having a relative magnetic permeability $\mu r$ which is kept within a range from 1 to 8.

According to the invention, the radiating electrode has a higher impedance, which results in a low Q factor in the antenna, and the bandwidth is accordingly increased.

The invention provides an antenna apparatus comprising:

a mounting substrate having formed thereon a feeding electrode and a ground conductor layer with a linear side edge located in a vicinity of the feeding electrode; and the surface-mount type antenna of the invention mentioned above, wherein the antenna apparatus is constructed by mounting the surface-mount type antenna on the mounting substrate, with the other principal surface of the base body arranged on a top surface of the mounting substrate, with the ridge of the base body arranged parallel to the linear side edge of the ground conductor layer, and with the feeding terminal connected to the feeding electrode.

According to the invention, the antenna apparatus includes the mounting substrate having formed thereon the feeding electrode and the ground conductor layer with a linear side edge located in the vicinity of the feeding electrode, and the surface-mount type antenna of the invention mentioned above. The antenna apparatus is constructed by mounting the surface-mount type antenna on the mounting substrate, with the other principal surface of the base body arranged on the top surface of the mounting substrate, with the ridge of the base body arranged parallel to the linear side edge of the ground conductor layer, and with the feeding terminal of the surface-mount type antenna of the invention connected to the feeding electrode. In this construction, the radiating electrode terminating portion of the surface-mount type antenna of the invention is arranged substantially parallel to the linear side edge of the ground conductor layer of the mounting substrate. Hence, in the antenna apparatus, the resonant frequency of the antenna can be adjusted with ease.

As described heretofore, according to the invention, there are provided a surface-mount type antenna and an antenna apparatus that succeed in readily attaining satisfactory antenna characteristics with stability, in enhancing radiation efficiency, and in achieving miniaturization and cost reduction.

BRIEF DESCRIPTION OF THE DRAWINGS

Other and further objects, features, and advantages of the invention will be more explicit from the following detailed description taken with reference to the drawings wherein:

FIG. 11 is a view of assistance in explaining variation in resonant frequency per unit length of the trimmed radiating electrode terminating portion.

DETAILED DESCRIPTION OF THE PREFERRED EMBODIMENTS

Figure 1A:
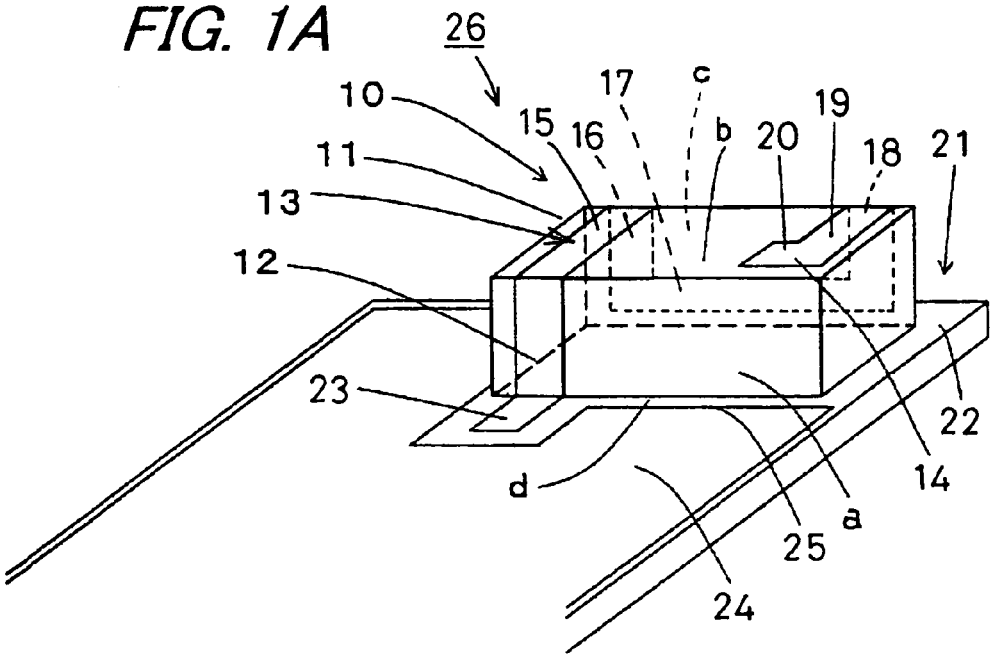
FIG. 1A is a perspective view showing a surface-mount type antenna according to a first embodiment of the invention, and also an antenna apparatus according to a first embodiment of the invention that is constituted by mounting the surface-mount type antenna on a top surface of a mounting substrate.

Now referring to the drawings, preferred embodiments of the invention are described below.

Hereafter, with reference to the accompanying drawings, a description will be given as to the embodiments of the surface-mount type antenna and the antenna apparatus according to the invention.

Figure 1B:
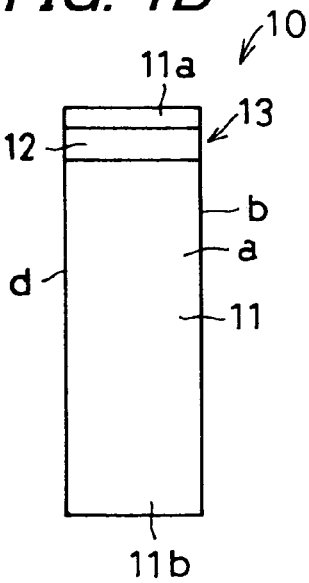
FIG. 1B is a view the surface-mount type antenna according to the first embodiment of the invention, viewed from one side surface side.
Figure 1C:
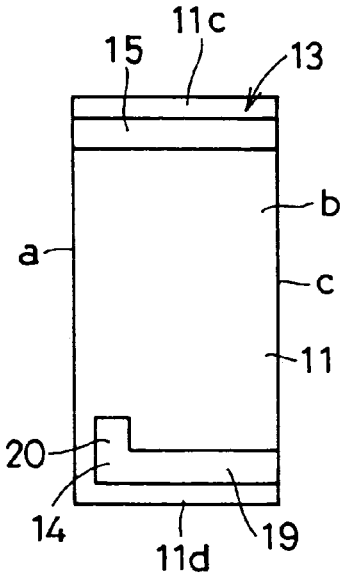
FIG. 1C is a view the surface-mount type antenna according to the first embodiment of the invention, viewed from one principal surface side.
Figure 1D:
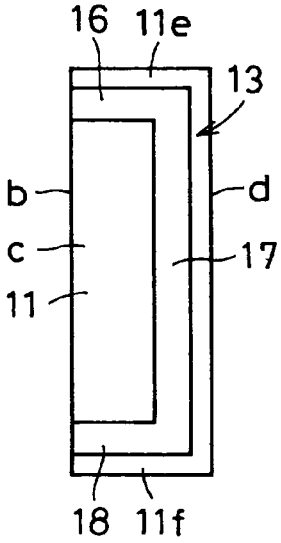
FIG. 1D is a view the surface-mount type antenna according to the first embodiment of the invention, viewed from another side surface side.
Figure 1E:
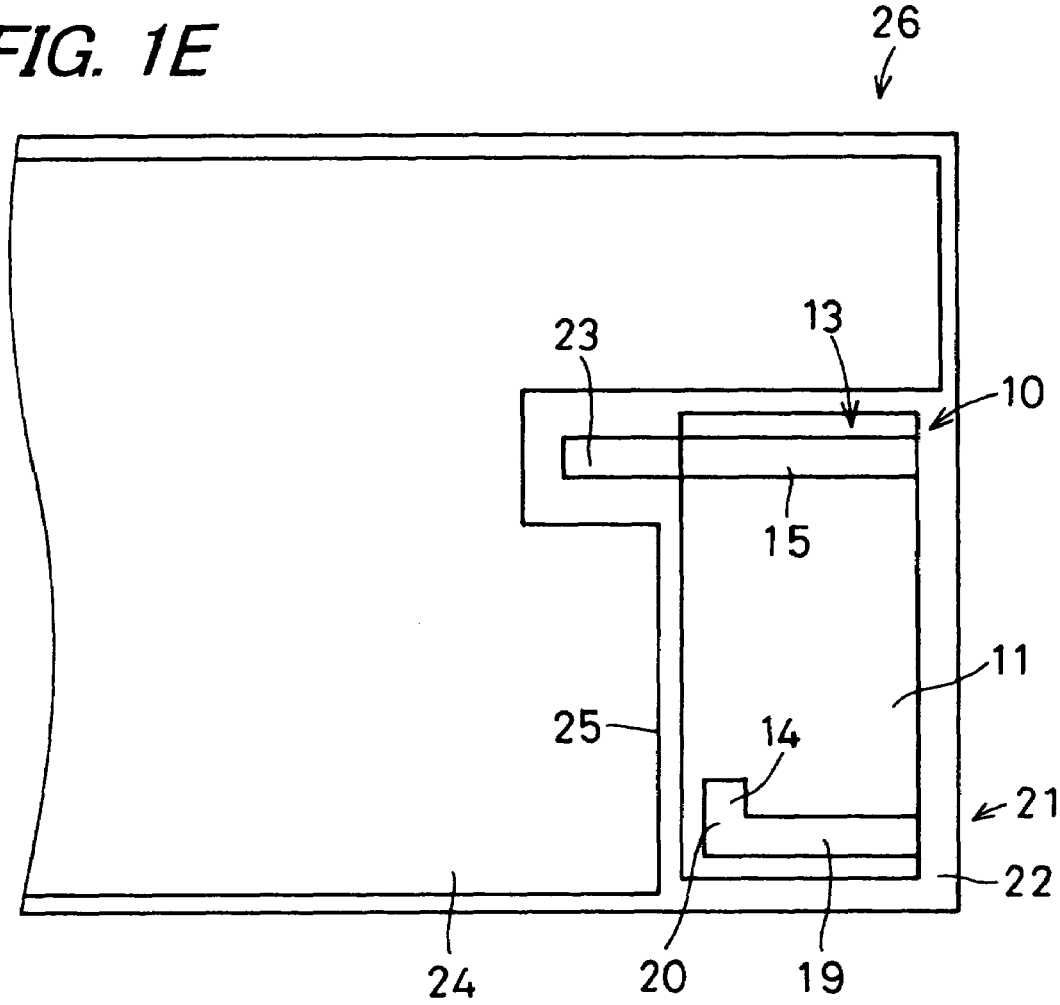
FIG. 1E is a plan view showing the surface-mount type antenna according to the first embodiment of the invention, and also the antenna apparatus according to the first embodiment of the invention that is constituted by mounting the surface-mount type antenna on the top surface of a mounting substrate.

FIG. 1A is a perspective view showing a surface-mount type antenna according to a first embodiment of the invention, and also an antenna apparatus according to a first embodiment of the invention that is constituted by mounting the surface-mount type antenna on a top surface of a mounting substrate; FIG. 1B is a view the surface-mount type antenna according to the first embodiment of the invention, viewed from one side surface side; FIG. 1C is a view the surface-mount type antenna according to the first embodiment of the invention, viewed from one principal surface side; FIG. 1D is a view the surface-mount type antenna according to the first embodiment of the invention, viewed from another side surface side; FIG. 1E is a plan view showing the surface-mount type antenna according to the first embodiment of the invention, and also the antenna apparatus according to the first embodiment of the invention that is constituted by mounting the surface-mount type antenna on the top surface of a mounting substrate.

In FIGS. 1A to 1E, a surface-mount type antenna 10 according to a first embodiment of the invention comprises a base body 11, a feeding terminal 12 and a radiating electrode 13 having a radiating electrode terminating portion 14. The base body 11 is made of a substantially rectangular parallelepiped dielectric or magnetic material. The feeding terminal 12 is formed at one end side part 11*a* of one side surface a of the base body 11. The radiating electrode 13, to one end of which is connected the feeding terminal 12, is disposed such that its other end extends from one end side part 11*a* of one side surface a, through one end side part 11*c* of one principal surface b, to one end side part 11*e* of another side surface c; is then turned, at a midpoint of the one end side part 11*e* thereof, toward another end side part 11*f* of the other side surface c; is further turned toward another end side part 11*d* of one principal surface b; is then routed on the other end side part 11*d* of one principal surface b; extends farther from the other end side part 11*d* of one principal surface b to the one end side part 11*c* of one principal surface b so as to be parallel to a longitudinal ridge of the base body 11; and is eventually formed into an open end. In addition, the radiating electrode terminating portion 14 refers to an end portion of the radiating electrode 13 routed on the other end side part 11*d* of one principal surface b, that is, that part of the radiating electrode 13 which extends from the other end side part 11*d* of one principal surface b to the open end.

For more detail, the radiating electrode 13 includes a first radiating electrode portion 15, a second radiating electrode portion 16, a third radiating electrode portion 17, a fourth radiating electrode portion 18, a fifth radiating electrode portion 19 and a sixth radiating electrode portion 20. The first radiating electrode portion 15 is connected to the feeding terminal 12 and extends from the one end side part 11*a* of one side surface a to the one end side part 11*c* of one principal surface b. The second radiating electrode portion 16 is connected to the first radiating electrode portion 15 and extends to a midpoint between one principal surface b and another principal surface d on a side of the one end side part 11*e* of the other side surface c. The third radiating electrode portion 17 is connected so as to be turned with respect to the second radiating electrode portion 16 and extends from the one end side part 11*e* toward the other side part 11*f* of the other side surface c. The fourth radiating electrode portion 18 is connected so as to be turned with respect to the third radiating electrode portion 17 and extends from the other end side part 11*f* of the the other side surface c toward the other end side part 11*d* of one principal surface b. The fifth radiating electrode portion 19 is connected to the fourth radiating electrode portion 18 and extends to a vicinity of the other end side part 11*b* of one side surface a on a side of the other end side part 11*d* of one principal surface b. The sixth radiating electrode portion 20 is connected to the fifth radiating electrode portion 19 and extends from the other end side part 11*d* of one principal surface b to the one end side part 11*c* of one principal surface b so as to be parallel to the longitudinal ridge of the base body 11.

Moreover, a mounting substrate 21 comprises a substrate 22, a feeding electrode 23 formed on a top surface of the substrate 22 and a ground conductor layer 24. The ground conductor layer 24 has a linear side edge 25 formed in a vicinity of the feeding electrode 23. Then, the surface-mount type antenna 10 according to the first embodiment of the invention is mounted on the mounting substrate 21, with the other principal surface d of the base body 11 arranged on the ground conductor layer 24-absent part of the top surface of the mounting substrate 21, with the longitudinal ridge of the base body 11 arranged parallel to the linear side edge 25 of the ground conductor layer 24, and with the feeding terminal 12 connected to the feeding electrode 23. Thereupon, an antenna apparatus 26 embodying the invention is realized.

In addition, to achieve impedance matching between the radiating electrode 13 of the surface-mount type antenna and the feeding electrode 23, a matching circuit (not shown) is disposed in the feeding electrode 23 of the mounting substrate 21 that is connected to the feeding terminal 12.

Here, the base body 11 has a rectangular parallelepiped shape. In the base body 11, the principal portion of the other principal surface d is made flat with consideration given to mountability with respect to the mounting substrate 21. By bringing the flat portion into contact with the flat surface of the mounting substrate 21, stable mountability can be attained. Note that it is preferable that the rectangular parallelepiped is chamfered at its corner and ridge to produce a curved or flat chamfer. This makes it possible to prevent a crack or chipping from occurring in the base body 11 made of a dielectric or magnetic material, to ease the mechanical stress occurring in the base body, and to decrease the possibility of a break in each joint in each radiating electrode portion 15, 16, 17, 18, 19 and 20 located in the ridge portion of the base body 11.

In the surface-mount type antenna 10 according to the first embodiment of the invention, a high-frequency signal fed from the feeding electrode 23 is transmitted to the radiating electrode 13, and the radiating electrode acts as $\lambda/4$ resonator. Thereby, the operation of the antenna is effected in response to the high-frequency signal supplied. Moreover, by constituting a matching circuit (not shown) for achieving impedance matching in the feeding electrode 23 on an as needed basis, the antenna can be operated efficiently. Further, the resonant frequency of the radiating electrode 13 can arbitrarily be varied by changing the electrical length between the open end and the feeding terminal 12 to which the radiating electrode 13 is connected. For example, the resonant frequency can be increased by reducing the length of the radiating electrode terminating portion 14, or by reducing the line width of the radiating electrode 13.

In this construction, the radiating electrode 13 is disposed such that its other end extends from the feeding terminal 12, through the one end side part 11*a* of one side surface a and the one end side part 11*c* of one principal surface b, to the one end side part 11*e* of the other side surface c; is then turned, at a mid point of the one end side part 11*e* thereof, toward the other end side part 11*f* of the other side surface c; is further turned toward the other end side part 11*d* of one principal surface b; is then routed toward the one end side part 11*c* of one principal surface b so as for the radiating electrode terminating portion 14 to be parallel to the longitudinal ridge of the base body 11; and is eventually formed into an open end. Then, the base body 11 is mounted on the mounting substrate 21, with the other principal surface d arranged on the top surface of the mounting substrate 21, and with the longitudinal ridge of the base body 11 arranged parallel to the linear side edge 25 of the ground conductor layer 24. That is, the radiating electrode terminating portion 14 is arranged parallel to the longitudinal ridge of the base body 11, and the longitudinal ridge of the base body 11 is arranged parallel to the linear side edge 25 of the ground conductor layer 24. Hence, the radiating electrode terminating portion 14 and the linear side edge 25 of the ground conductor layer 24 are arranged substantially parallel to each other. Here, it is important that the radiating electrode terminating portion 14 and the linear side edge 25 of the ground conductor layer 24 be arranged substantially parallel to each other.

Moreover, according to the surface-mount type antenna 10 thus mounted and the antenna apparatus 26 according to the first embodiment of the invention, since the radiating electrode 13 is arranged in proximity to the ground conductor layer 24, a stray capacitance is created between the radiating electrode 13 and the ground conductor layer 24. The stray capacitance contributes to reduction in the resonant frequency of the antenna. Thus, to stabilize the antenna characteristics, it is essential to minimize variation in the stray capacitance.

In this construction, the radiating electrode terminating portion 14 extends in parallel with the longitudinal ridge of the base body 11 as the open end. The base body 11 is mounted on the mounting substrate 21, with its other principal surface d arranged on the top surface of the mounting substrate 21, and with its longitudinal ridge arranged parallel to the linear side edge 25 of the ground conductor layer 24. In this way, the radiating electrode terminating portion 14 is arranged in proximity to the ground conductor layer 24, and is thus predominant over the stray capacitance created. Here, since the radiating electrode terminating portion 14 is arranged substantially parallel to the linear side edge 25 of the ground conductor layer 24, even if a change is made to the length of the radiating electrode terminating portion 14, variation in the interval between the radiating electrode terminating portion 14 and the ground conductor layer 24 can be suppressed, and correspondingly variation in the resonant frequency accompanied by variation in the stray capacitance created between the ground conductor layer 24 and the radiating electrode terminating portion 14 can be reduced successfully. This is advantageous in terms of fine adjustment of the resonant frequency that is important to achieve satisfactory antenna characteristics. Specifically, in the case of making adjustment to the length of the radiating electrode terminating portion 14, it is possible to exploit mainly variation in the resonant frequency resulting from variation in the electrical length of the radiating electrode, while the influence of the stray capacitance created between the radiating electrode terminating portion 14 and the ground conductor layer 24 is reduced. Hence, the amount of variation in the resonant frequency per unit length can be reduced by the reduction of the influence of the stray capacitance.

Then, the surface-mount type antenna 10 according to the first embodiment of the invention thus constructed is mounted, with a distance of for example approximately 0.5 mm to 3 mm secured between the ridge of the base body 11 and the linear side edge 25 of the ground conductor layer 24. Simultaneously, the feeding terminal 12 is connected to the feeding electrode 23. Thereupon, the antenna apparatus 26 of the invention is operable at a frequency band of approximately 1 GHz to 10 GHz, for example.

Figure 10:
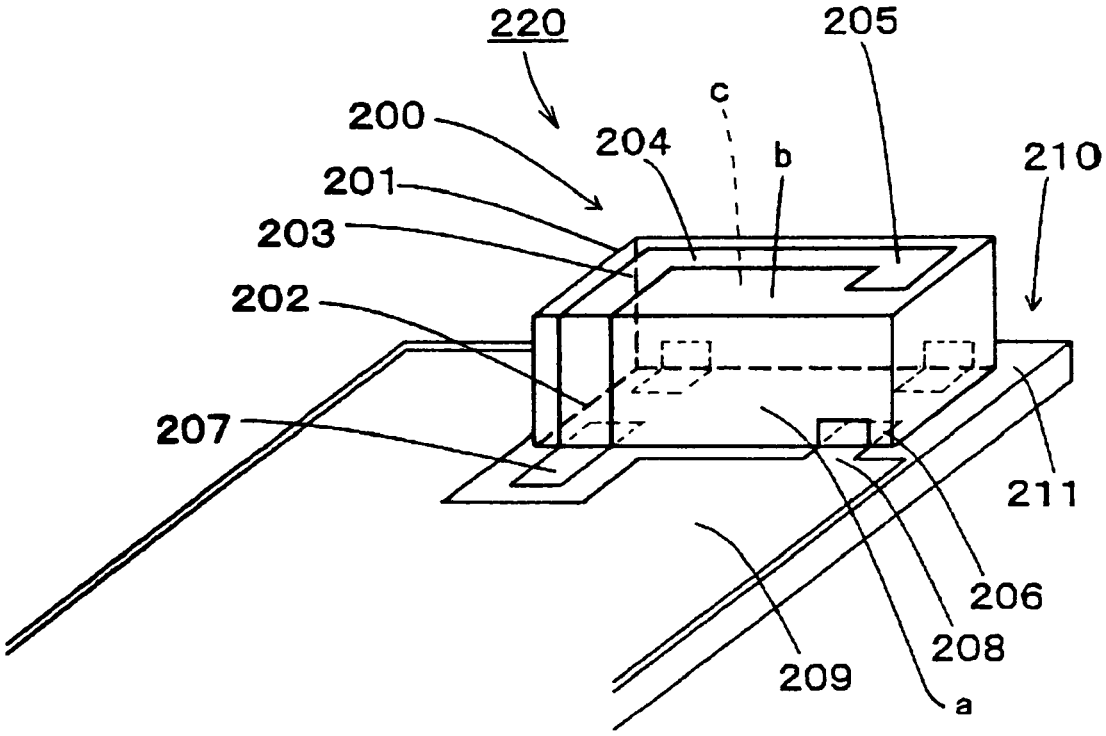
FIG. 10 PRIOR ART
FIG. 10 is a perspective view showing an example of a conventional surface-mount type antenna and an antenna apparatus incorporating the antenna.

By contrast, in the conventional antenna apparatus 220 shown in FIG. 10, the radiating electrode 205 is disposed with its radiating electrode terminating portion aligned with the shorter side of the base body 203. That is, the radiating electrode is arranged perpendicularly to the ground conductor layer 209 of the mounting substrate 210. In this case, if the radiating electrode terminating portion of the radiating electrode 205 is shortened, the interval between the ground conductor layer 209 and the radiating electrode 205 is correspondingly increased, and thus the stray capacitance created between the ground conductor layer 209 and the radiating electrode 205 varies greatly. This is disadvantageous in terms of fine adjustment of the resonant frequency that is important to achieve satisfactory antenna characteristics. Specifically, in the case of making adjustment to the length of the radiating electrode terminating portion, the resonant frequency is varied with the change of the electrical length of the radiating electrode and with the change of the stray capacitance created between the ground conductor layer 209 and the radiating electrode 205. Due to the influence of the variation of the resonant frequency, the amount of variation in the resonant frequency per unit length of the radiating electrode is undesirably increased, which leads to the difficulty in making fine adjustment of the resonant frequency that is important to achieve satisfactory antenna characteristics.

That is, in the surface-mount type antenna 10 and the antenna apparatus 26 according to the first embodiment of the invention, since the radiating electrode terminating portion 14 and the linear side edge 25 of the ground conductor layer 24 are arranged in substantially parallel positional relation, even if adjustment is made to the length of the radiating electrode terminating portion 14 to adjust the resonant frequency of the antenna, variation in the interval between the radiating electrode terminating portion 14 and the ground conductor layer 24 can be kept slight. Correspondingly, variation in the stray capacitance created between the radiating electrode terminating portion 14 and the ground conductor layer 24 can also be kept slight. As a result, the amount of variation in the resonant frequency of the antenna corresponding to the amount of variation in the length of the radiating electrode terminating portion 14 is reduced. In other words, since the sensitivity in the change of the antenna resonant frequency to the length adjustment for the radiating electrode terminating portion 14 is lowered, allowance can be made for the range of adjustment to the length of the radiating electrode terminating portion 14. This helps facilitate the resonant-frequency adjustment in the antenna. The appreciable advantages brought about by the construction of the invention have already been confirmed through experiments. The test results will be explained in detail later by way of Practical examples.

FIGS. 2A to 2E, 3A to 3E, and 4A to 4G are views showing surface-mount type antennas according to second to fourth embodiments of the invention.

Figure 2A:
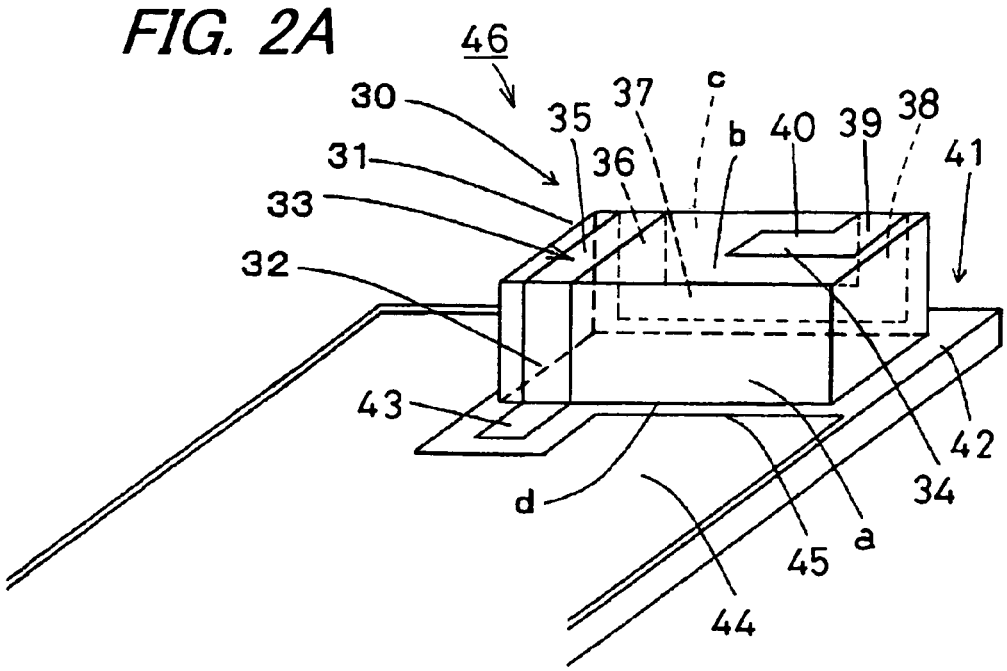
FIG. 2A is a perspective view showing a surface-mount type antenna according to a second embodiment of the invention, and also an antenna apparatus according to a second embodiment of the invention that is constituted by mounting the surface-mount type antenna on a top surface of a mounting substrate.
Figure 2B:
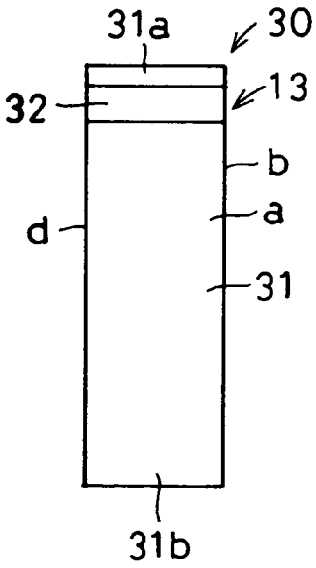
FIG. 2B is a view the surface-mount type antenna according to the second embodiment of the invention, viewed from one side surface side.
Figure 2C:
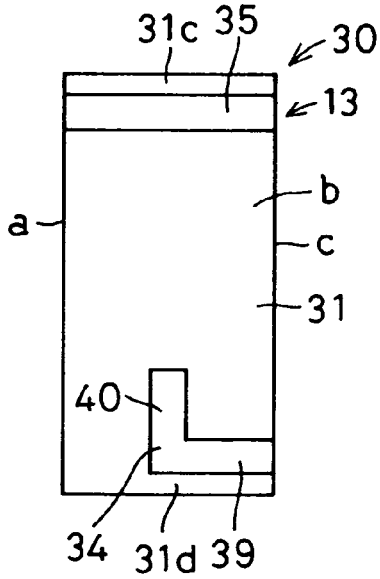
FIG. 2C is a view the surface-mount type antenna according to the second embodiment of the invention, viewed from one principal surface side.
Figure 2D:
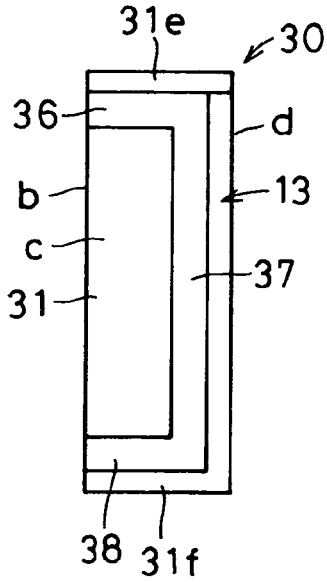
FIG. 2D is a view the surface-mount type antenna according to the second embodiment of the invention, viewed from another side surface side.
Figure 2E:
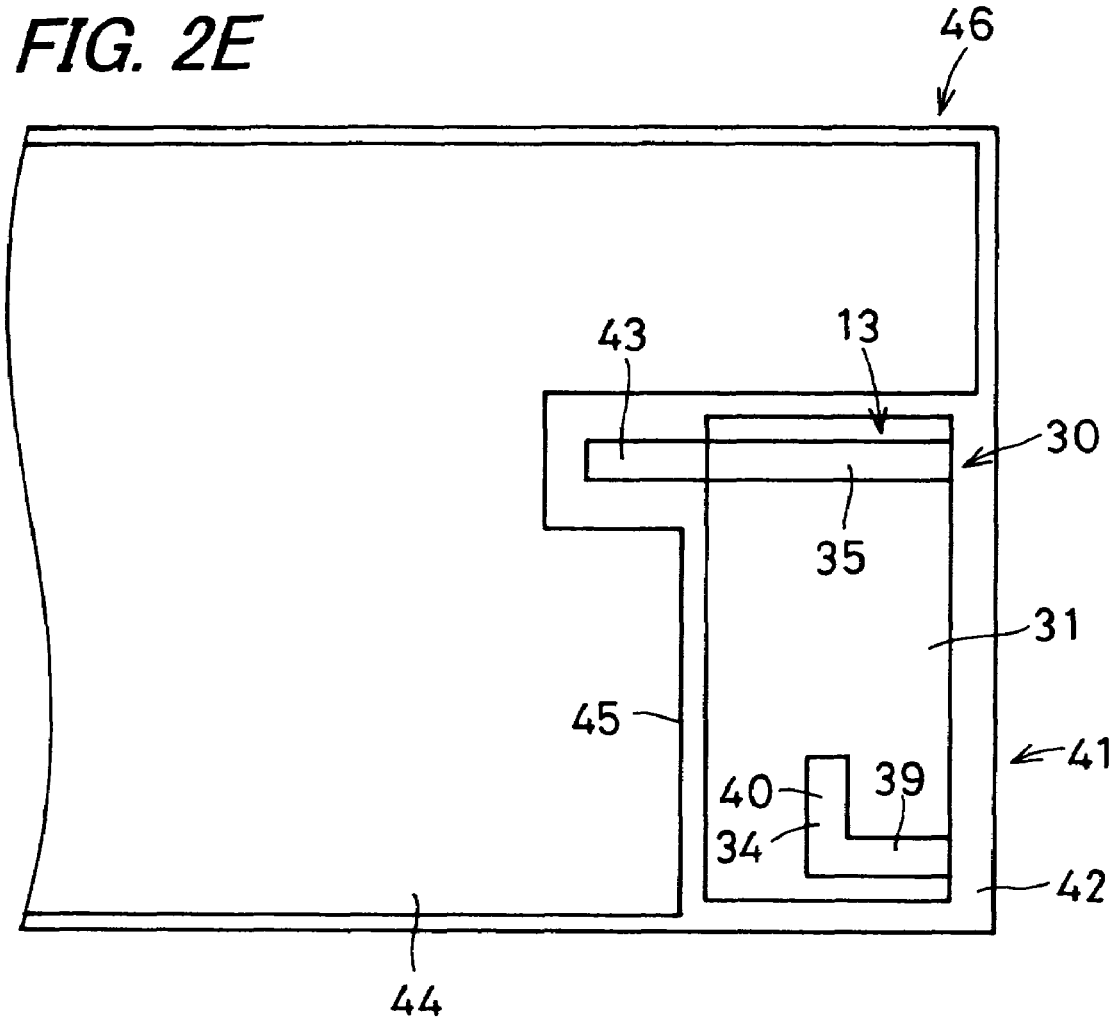
FIG. 2E is a plan view showing the surface-mount type antenna according to the second embodiment of the invention, and also the antenna apparatus according to the second embodiment of the invention that is constituted by mounting the surface-mount type antenna on the top surface of the mounting substrate.

FIG. 2A is a perspective view showing a surface-mount type antenna according to a second embodiment of the invention, and also an antenna apparatus according to a second embodiment of the invention that is constituted by mounting the surface-mount type antenna on a top surface of a mounting substrate; FIG. 2B is a view the surface-mount type antenna according to the second embodiment of the invention, viewed from one side surface side; FIG. 2C is a view the surface-mount type antenna according to the second embodiment of the invention, viewed from one principal surface side; FIG. 2D is a view the surface-mount type antenna according to the second embodiment of the invention, viewed from another side surface side; and FIG. 2E is a plan view showing the surface-mount type antenna according to the second embodiment of the invention, and also the antenna apparatus according to the second embodiment of the invention that is constituted by mounting the surface-mount type antenna on the top surface of the mounting substrate.

In FIGS. 2A to 2E, a surface-mount type antenna 30 according to the second embodiment of the invention comprises a base body 31, a feeding terminal 32 and a radiating electrode 33 having a radiating electrode terminating portion 34. The base body 31 is made of a substantially rectangular parallelepiped dielectric or magnetic material. The feeding terminal 32 is formed at one end side part 31*a* of one side surface a of the base body 31. The radiating electrode 33, to one end of which is connected the feeding terminal 32, is disposed such that its other end extends from one end side part 31*a* of one side surface a, through one end side part 31*c* of one principal surface b, to one end side part 31*e* of another side surface c; is then turned, at a midpoint of the one end side part 31*e* thereof, toward another end side part 31*f* of the other side surface c; is further turned; is then routed on the other end side part 31*d* of one principal surface b; is turned from a midpoint of the other end side part 31*d* of one principal surface b and extends farther from the other end side part 31*d* of one principal surface b to the one end side part 31*c* of one principal surface b so as to be parallel to a longitudinal ridge of the base body 31; and is eventually formed into an open end. In addition, the radiating electrode terminating portion 34 refers to an end portion of the radiating electrode 33 routed on the other end side part 31*d* of one principal surface b, that is, that part of the radiating electrode 33 which extends from the other end side part 31*d* of one principal surface b to the open end.

For more detail, the radiating electrode 33 includes a first radiating electrode portion 35, a second radiating electrode portion 36, a third radiating electrode portion 37, a fourth radiating electrode portion 38, a fifth radiating electrode portion 39 and a sixth radiating electrode portion 40. The first radiating electrode portion 35 is connected to the feeding terminal 32 and extends from the one end side part 31*a* of one side surface a to the one end side part 31*c* of one principal surface b. The second radiating electrode portion 36 is connected to the first radiating electrode portion 35 and extends to a midpoint between one principal surface b and another principal surface d on a side of the one end side part 31*e* of the other side surface c. The third radiating electrode portion 37 is connected so as to be turned with respect to the second radiating electrode portion 36 and extends from the one end side part 31*e* toward the other side part 31*f* of the other side surface c. The fourth radiating electrode portion 38 is connected so as to be turned with respect to the third radiating electrode portion 37 and extends from the other end side part 31*f* of the the other side surface c toward the other end side part 31*d* of one principal surface b. The fifth radiating electrode portion 39 is connected to the fourth radiating electrode portion 38 and extends to a vicinity of a center portion in a lateral direction of the other end side part 31*d* of one principal surface b. The sixth radiating electrode portion 40 is connected to the fifth radiating electrode portion 39 and extends from the other end side part 31*d* of one principal surface b to the one end side part 31*c* of one principal surface b so as to be parallel to the longitudinal ridge of the base body 31.

Moreover, a mounting substrate 41 comprises a substrate 42, a feeding electrode 43 formed on a top surface of the substrate 42 and a ground conductor layer 44. The ground conductor layer 44 has a linear side edge 45 formed in a vicinity of the feeding electrode 43. Then, the surface-mount type antenna 30 according to the second embodiment of the invention is mounted on the mounting substrate 41, with the other principal surface d of the base body 41 arranged on the ground conductor layer 44-absent part of the top surface of the mounting substrate 41, with the longitudinal ridge of the base body 41 arranged parallel to the linear side edge 45 of the ground conductor layer 44, and with the feeding terminal 32 connected to the feeding electrode 43. Thereupon, an antenna apparatus 46 embodying the invention is realized.

That is, the radiating electrode terminating portion 34 is arranged parallel to the longitudinal ridge of the base body 31. The base body 31 is mounted, with its longitudinal ridge arranged parallel to the linear side edge 45 of the ground conductor layer 44. In this way, the radiating electrode terminating portion 34 is arranged substantially parallel to the linear side edge 45 of the ground conductor layer 44.

Moreover, the surface-mount type antenna 30 according to the second embodiment of the invention shown in FIGS. 2A to 2E is similar in structure to the surface-mount type antenna 10 according to the first embodiment of the invention shown in FIGS. 1A to 1E, but the difference is that the radiating electrode terminating portion 34 is disposed closer to the center of one principal surface b.

Then, the surface-mount type antenna 30 according to the second embodiment of the invention thus constructed is mounted, with a distance of for example approximately 0.5 mm to 3 mm secured between the ridge of the base body 31 and the linear side edge 45 of the ground conductor layer 44. Simultaneously, the feeding terminal 32 is connected to the feeding electrode 43. Thereupon, the antenna apparatus 46 of the invention is operable at a frequency band of approximately 1 GHz to 10 GHz, for example.

Figure 3A:
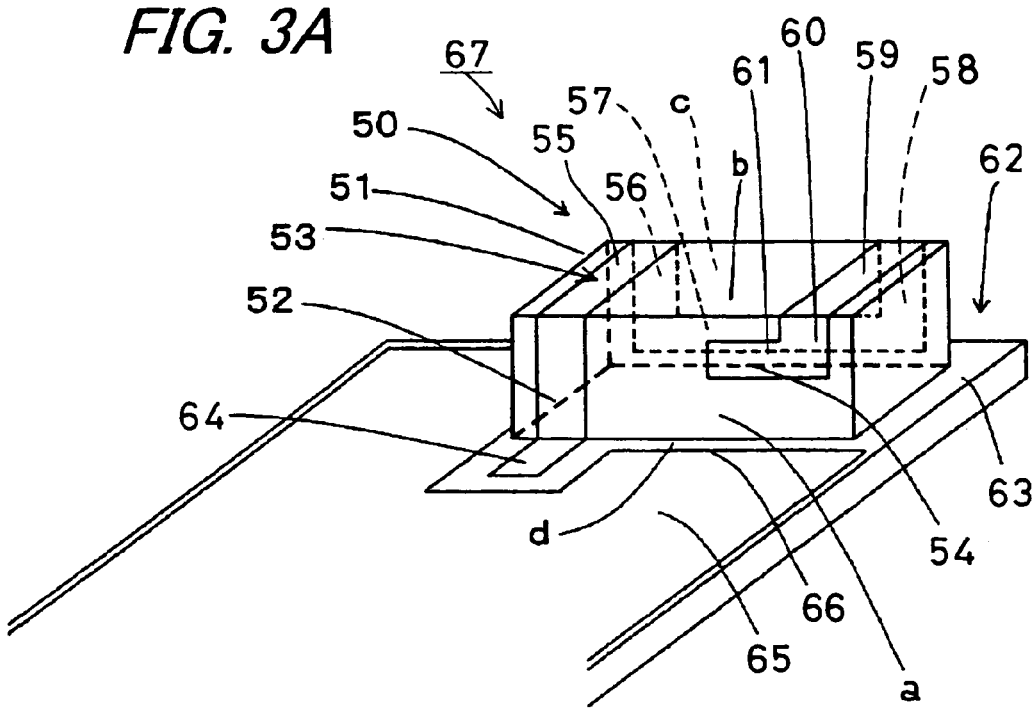
FIG. 3A is a perspective view showing a surface-mount type antenna according to a third embodiment of the invention, and also an antenna apparatus according to a third embodiment of the invention that is constituted by mounting the surface-mount type antenna on a top surface of a mounting substrate.
Figure 3B:
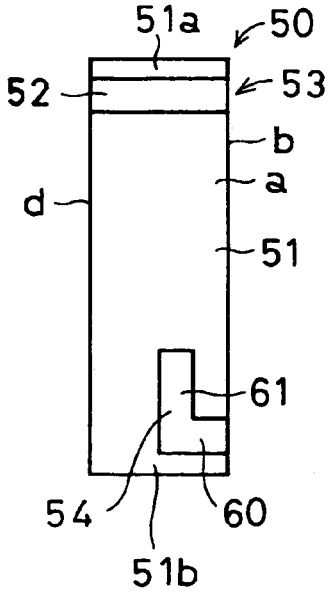
FIG. 3B is a view the surface-mount type antenna according to the third embodiment of the invention, viewed from one side surface side.
Figure 3C:
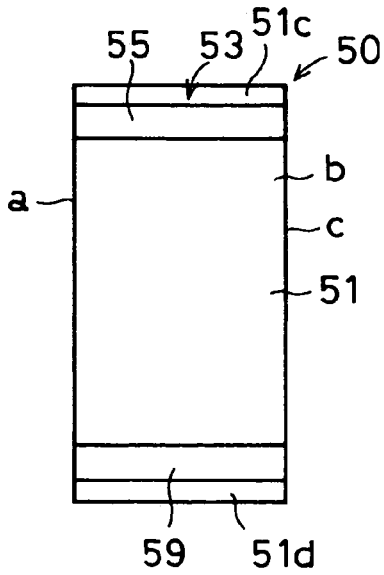
FIG. 3C is a view the surface-mount type antenna according to the third embodiment of the invention, viewed from one principal surface side.
Figure 3D:
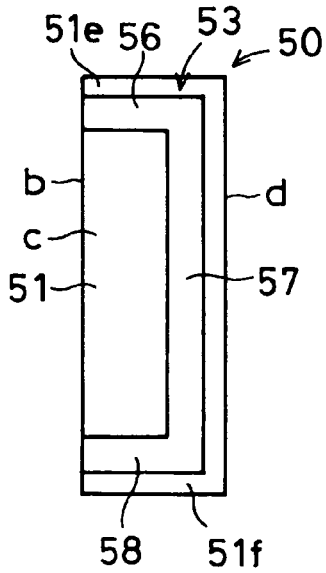
FIG. 3D is a view the surface-mount type antenna according to the third embodiment of the invention, viewed from another side surface side.
Figure 3E:
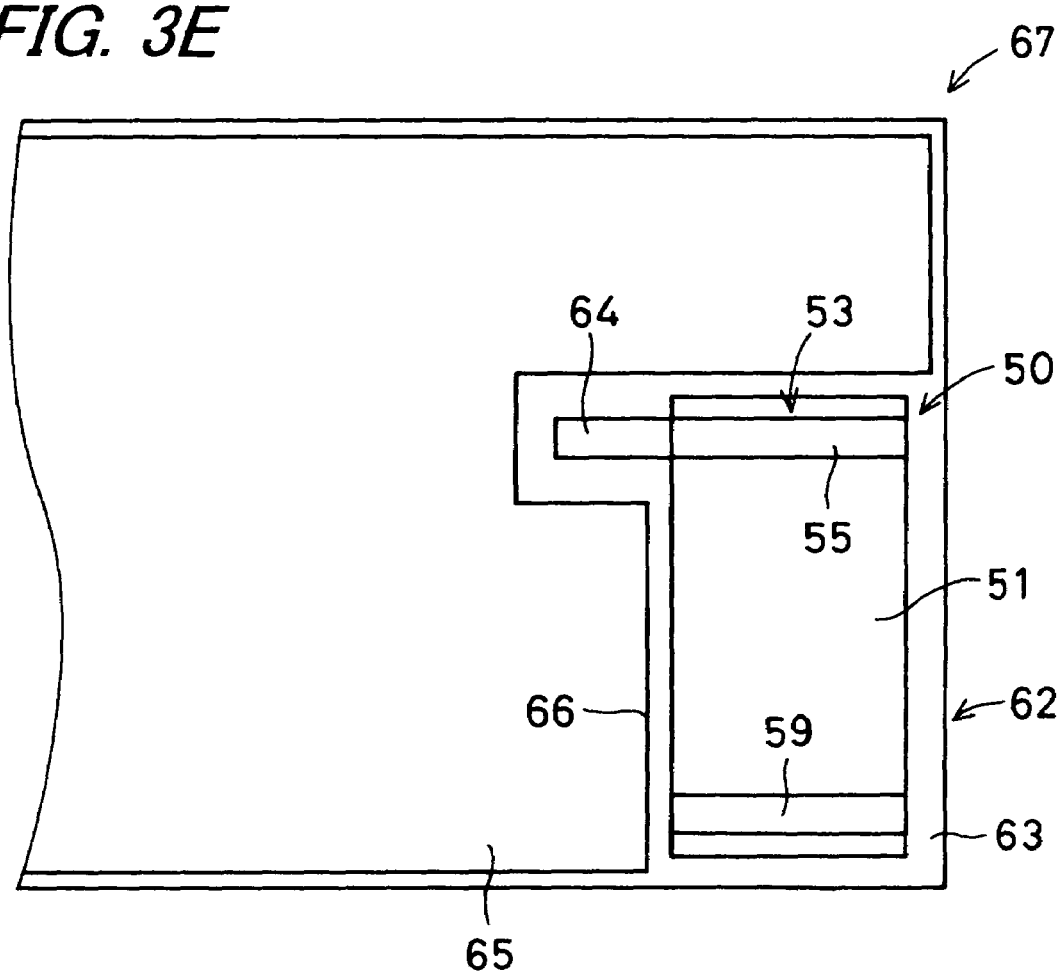
FIG. 3E is a plan view showing the surface-mount type antenna according to the third embodiment of the invention, and also the antenna apparatus according to the third embodiment of the invention that is constituted by mounting the surface-mount type antenna on the top surface of the mounting substrate.

FIG. 3A is a perspective view showing a surface-mount type antenna according to a third embodiment of the invention, and also an antenna apparatus according to a third embodiment of the invention that is constituted by mounting the surface-mount type antenna on a top surface of a mounting substrate; FIG. 3B is a view the surface-mount type antenna according to the third embodiment of the invention, viewed from one side surface side; FIG. 3C is a view the surface-mount type antenna according to the third embodiment of the invention, viewed from one principal surface side; FIG. 3D is a view the surface-mount type antenna according to the third embodiment of the invention, viewed from another side surface side; and FIG. 3E is a plan view showing the surface-mount type antenna according to the third embodiment of the invention, and also the antenna apparatus according to the third embodiment of the invention that is constituted by mounting the surface-mount type antenna on the top surface of the mounting substrate.

Next, in FIGS. 3A to 3E, a surface-mount type antenna 50 according to the third embodiment of the invention comprises a base body 51, a feeding terminal 52 and a radiating electrode 53 having a radiating electrode terminating portion 54. The base body 51 is made of a substantially rectangular parallelepiped dielectric or magnetic material. The feeding terminal 52 is formed at one end side part 51*a* of one side surface a of the base body 51. The radiating electrode 53, to one end of which is connected the feeding terminal 52, is disposed such that its other end extends from one end side part 51*a* of one side surface a, through one end side part 51*c* of one principal surface b, to one end side part 51*e* of another side surface c; is then turned, at a midpoint of the one end side part 51*e* thereof, toward another end side part 51*f* of the other side surface c; is further turned and extends toward another end side part 51*d* of one principal surface b; is then routed from the other end side part 51*d* of one principal surface b to another end side part 51*b* of one side surface a; is then turned at an appropriate position of the other end side part 51*b* of one side surface a; extends farther from the other end side part 51*b* of one side surface a to the one end side part 51*a* of one side surface a so as to be parallel to a longitudinal ridge of the base body 51; and is eventually formed into an open end. In addition, the radiating electrode terminating portion 54 refers to an end portion of the radiating electrode 53 routed on the other end side part 51*b* of one side surface a, that is, that part of the radiating electrode 53 which extends from the other end side part 51*b* of one side surface a to the open end.

For more detail, the radiating electrode 53 includes a first radiating electrode portion 55, a second radiating electrode portion 56, a third radiating electrode portion 57, a fourth radiating electrode portion 58, a fifth radiating electrode portion 59, a sixth radiating electrode portion 60 and a seventh radiating electrode portion 61. The first radiating electrode portion 55 is connected to the feeding terminal 52 and extends from the one end side part 51*a* of one side surface a to the one end side part 51*c* of one principal surface b. The second radiating electrode portion 56 is connected to the first radiating electrode portion 55 and extends to a midpoint between one principal surface b and another principal surface d on a side of the one end side part 51*e* of the other side surface c. The third radiating electrode portion 57 is connected so as to be turned with respect to the second radiating electrode portion 56 and extends from the one end side part 51*e* toward the other side part 51*f* of the other side surface c. The fourth radiating electrode portion 58 is connected so as to be turned with respect to the third radiating electrode portion 57 and extends from the other end side part 51*f* of the the other side surface c toward the other end side part 51*d* of one principal surface b. The fifth radiating electrode portion 59 is connected to the fourth radiating electrode portion 58 and extends to the other end side part 51*b* of one side surface a on a side of the other end side part 51*d* of one principal surface b. The sixth radiating electrode portion 60 is connected to the fifth radiating electrode portion 59 and extends to an appropriate position on a side of the other end side part 51*b* of one side surface a. The seventh radiating electrode portion 61 is connected so as to be turned with respect to the sixth radiating electrode portion 60 and extends to the one end side part 51*a* of one side surface a so as to be parallel to the longitudinal ridge of the base body 51.

Moreover, a mounting substrate 62 comprises a substrate 63, a feeding electrode 64 formed on a top surface of the substrate 63 and a ground conductor layer 65. The ground conductor layer 65 has a linear side edge 66 formed in a vicinity of the feeding electrode 64. Then, the surface-mount type antenna 50 according to the third embodiment of the invention is mounted on the mounting substrate 62, with the other principal surface d of the base body 51 arranged on the ground conductor layer 65-absent part of the top surface of the mounting substrate 62, with the longitudinal ridge of the base body 51 arranged parallel to the linear side edge 66 of the ground conductor layer 65, and with the feeding terminal 52 connected to the feeding electrode 64. Thereupon, an antenna apparatus 67 embodying the invention is realized.

That is, the radiating electrode terminating portion 54 is arranged parallel to the longitudinal ridge of the base body 51. The base body 51 is mounted, with its longitudinal ridge arranged parallel to the linear side edge 66 of the ground conductor layer 65. In this way, the radiating electrode terminating portion 54 is arranged substantially parallel to the linear side edge 66 of the ground conductor layer 65.

Moreover, the surface-mount type antenna 50 according to the third embodiment of the invention shown in FIGS. 3A to 3E is similar in structure to the surface-mount type antenna 10 according to the first embodiment of the invention shown in FIGS. 1A to 1E, but the difference is that the radiating electrode 53 is routed from the one end side part 51*c* of one principal surface b to the other end side part 51*b* of one side surface a and the radiating electrode terminating portion 54 is disposed on one side surface a.

Then, the surface-mount type antenna 50 according to the third embodiment of the invention thus constructed is mounted, with a distance of for example approximately 0.5 mm to 3 mm secured between the ridge of the base body 51 and the linear side edge 66 of the ground conductor layer 65. Simultaneously, the feeding terminal 52 is connected to the feeding electrode 64. Thereupon, the antenna apparatus 67 of the invention is operable at a frequency band of approximately 1 GHz to 10 GHz, for example.

Figure 4A:
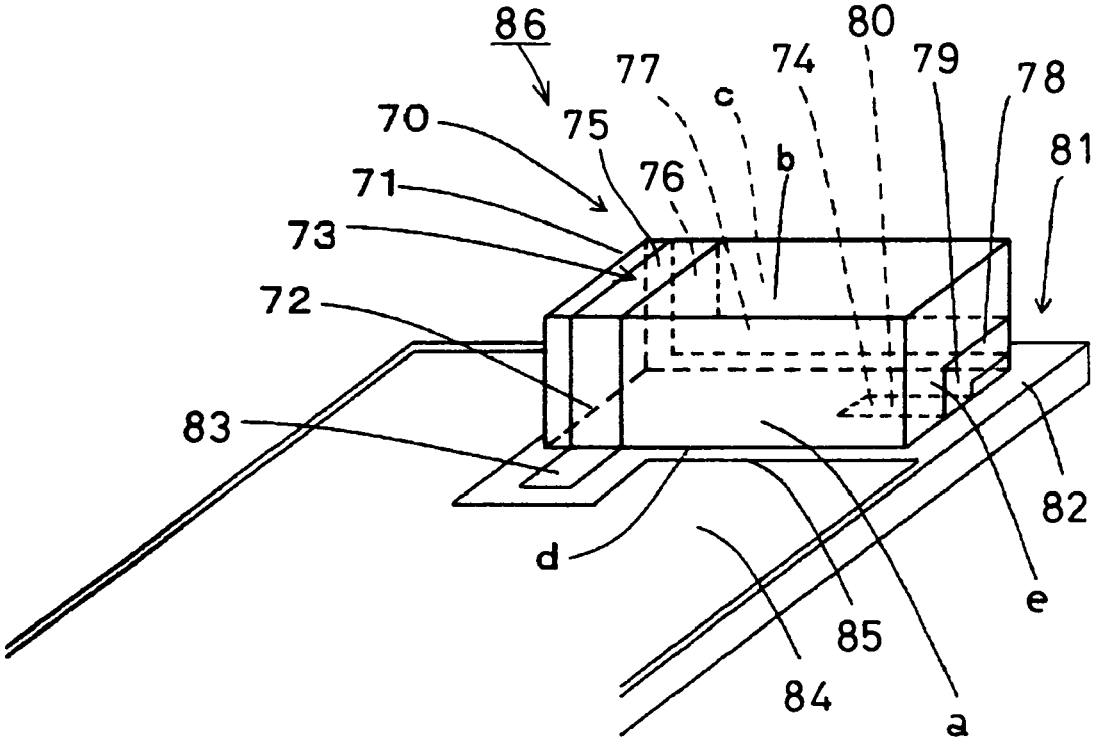
FIG. 4A is a perspective view showing a surface-mount type antenna according to a fourth embodiment of the invention, and also an antenna apparatus according to a fourth embodiment of the invention that is constituted by mounting the surface-mount type antenna on a top surface of a mounting substrate.
Figure 4B:
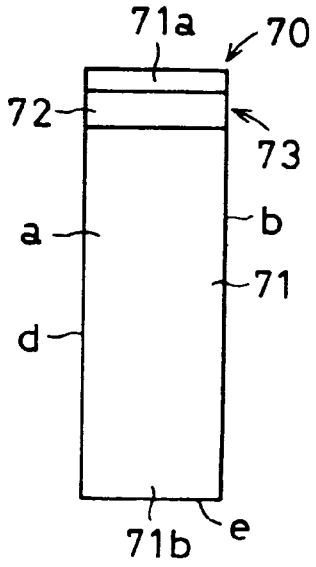
FIG. 4B is a view the surface-mount type antenna according to the fourth embodiment of the invention, viewed from one side surface side.
Figure 4C:
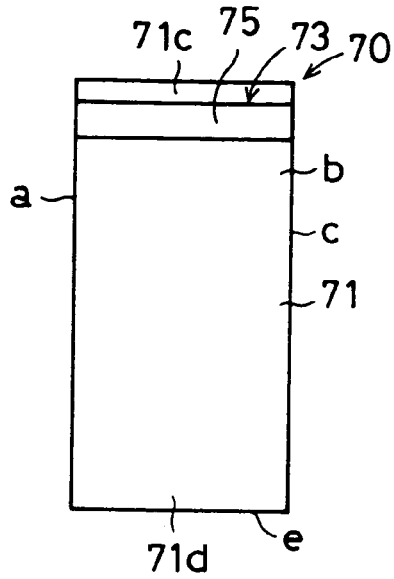
FIG. 4C is a view the surface-mount type antenna according to the fourth embodiment of the invention, viewed from one principal surface side.
Figure 4D:
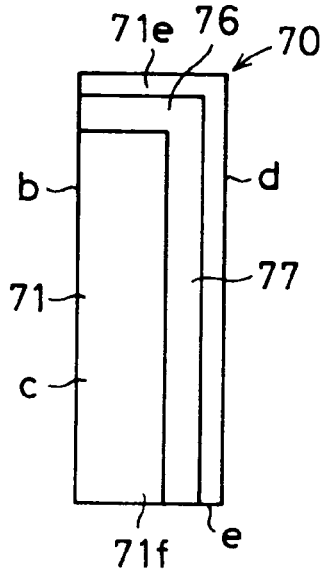
FIG. 4D is a view the surface-mount type antenna according to the fourth embodiment of the invention, viewed from another side surface side.
Figure 4E:
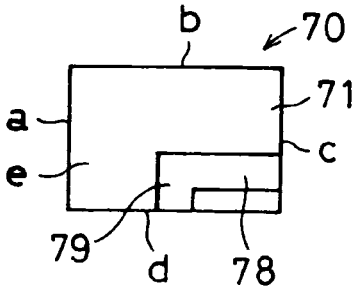
FIG. 4E is a view the surface-mount type antenna according to the fourth embodiment of the invention, viewed from another end face side.
Figure 4F:
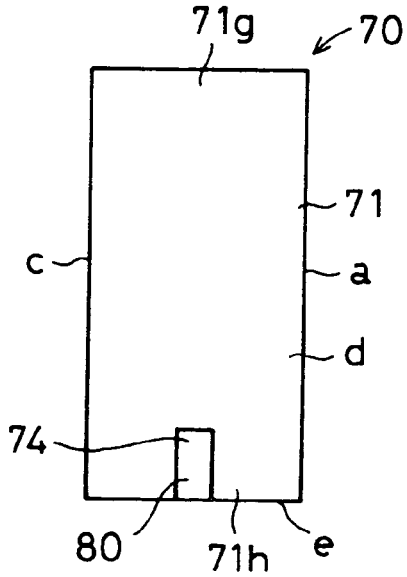
FIG. 4F is a view the surface-mount type antenna according to the fourth embodiment of the invention, viewed from another principal surface side.
Figure 4G:
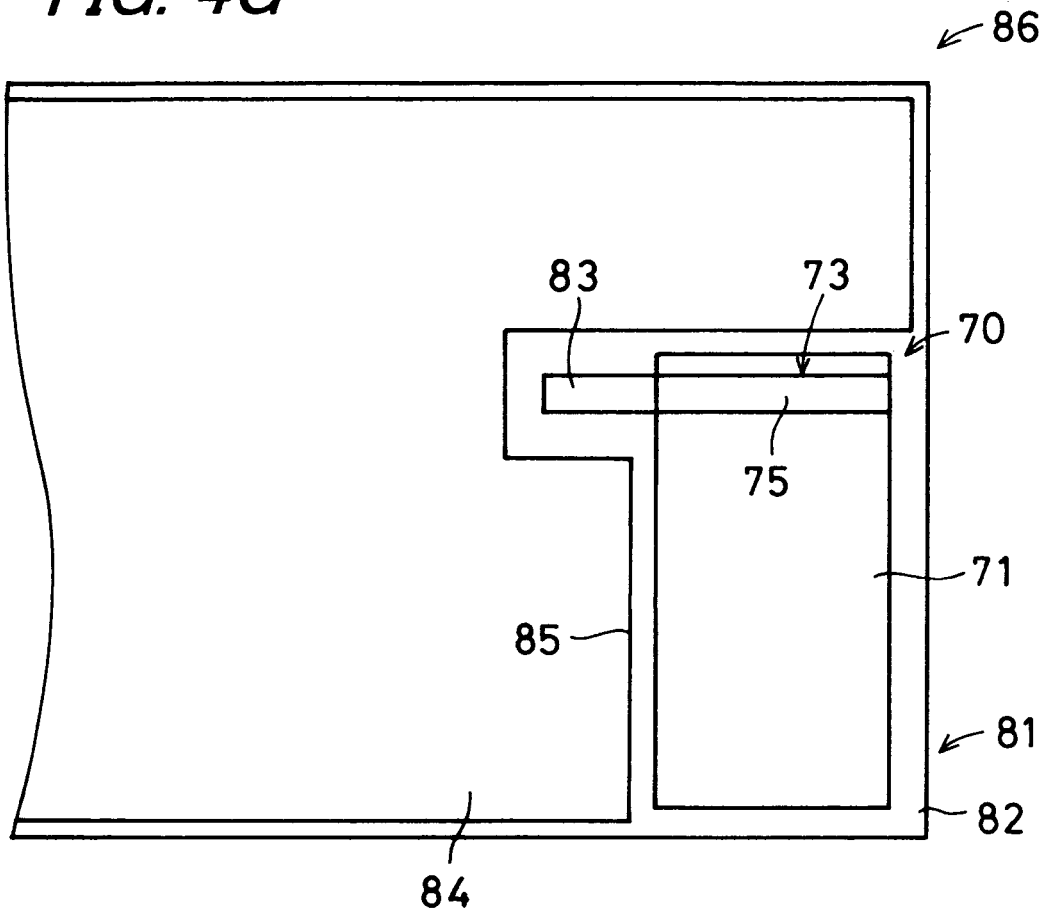
FIG. 4G is a plan view showing the surface-mount type antenna according to the fourth embodiment of the invention, and also the antenna apparatus according to the fourth embodiment of the invention that is constituted by mounting the surface-mount type antenna on the top surface of the mounting substrate.

FIG. 4A is a perspective view showing a surface-mount type antenna according to a fourth embodiment of the invention, and also an antenna apparatus according to a fourth embodiment of the invention that is constituted by mounting the surface-mount type antenna on a top surface of a mounting substrate; FIG. 4B is a view the surface-mount type antenna according to the fourth embodiment of the invention, viewed from one side surface side; FIG. 4C is a view the surface-mount type antenna according to the fourth embodiment of the invention, viewed from one principal surface side; FIG. 4D is a view the surface-mount type antenna according to the fourth embodiment of the invention, viewed from another side surface side; FIG. 4E is a view the surface-mount type antenna according to the fourth embodiment of the invention, viewed from another end face side; FIG. 4F is a view the surface-mount type antenna according to the fourth embodiment of the invention, viewed from another principal surface side; and FIG. 4G is a plan view showing the surface-mount type antenna according to the fourth embodiment of the invention, and also the antenna apparatus according to the fourth embodiment of the invention that is constituted by mounting the surface-mount type antenna on the top surface of the mounting substrate.

Next, in FIGS. 4A to 4G, a surface-mount type antenna 70 according to the fourth embodiment of the invention comprises a base body 71, a feeding terminal 72 and a radiating electrode 73 having a radiating electrode terminating portion 74. The base body 71 is made of a substantially rectangular parallelepiped dielectric or magnetic material. The feeding terminal 72 is formed at one end side part 71*a* of one side surface a of the base body 71. The radiating electrode 73, to one end of which is connected the feeding terminal 72, is disposed such that its other end extends from one end side part 71*a* of one side surface a, through one end side part 71*c* of one principal surface b, to one end side part 71*e* of another side surface c; is then turned, at a midpoint of the one end side part 71*e* thereof, toward another end side part 71*f* of the other side surface c; extends farther toward one side surface a on another end face e; is turned at a midpoint thereof toward another principal surface d; is then routed on another end side part 71*h* of the other principal surface d; extends farther from the other end side part 71*h* of the other principal surface d to one end side part 71*g* of the other principal surface d so as to be parallel to a longitudinal ridge of the base body 71; and is eventually formed into an open end. In addition, the radiating electrode terminating portion 74 refers to an end portion of the radiating electrode 73 routed on the other end side part 71*h* of the other principal surface d, that is, that part of the radiating electrode 73 which extends from the other end side part 71*h* of the other principal surface d to the open end.

For more detail, the radiating electrode 73 includes a first radiating electrode portion 75, a second radiating electrode portion 76, a third radiating electrode portion 77, a fourth radiating electrode portion 78, a fifth radiating electrode portion 79 and a sixth radiating electrode portion 80. The first radiating electrode portion 75 is connected to the feeding terminal 72 and extends from the one end side part 71*a* of one side surface a to the one end side part 71*c* of one principal surface b. The second radiating electrode portion 76 is connected to the first radiating electrode portion 75 and extends to a midpoint between one principal surface b and another principal surface d on a side of the one end side part 71*e* of the other side surface c. The third radiating electrode portion 77 is connected so as to be turned with respect to the second radiating electrode portion 76 and extends from the one end side part 71*e* toward the other side part 71*f* of the other side surface c. The fourth radiating electrode portion 78 is connected to the third radiating electrode portion 77 and extends to a vicinity of a center portion in a lateral direction toward one side surface a on the other end face e. The fifth radiating electrode portion 79 is connected so as to be turned with respect to the fourth radiating electrode portion 78 and extends on a side of the other end side part 71*h* of the other principal surface d. The sixth radiating electrode portion 80 is connected to the fifth radiating electrode portion 79 and extends from the other end side part 71*h* of the other principal surface d to the one end side part 71*g* of the other principal surface d so as to be parallel to the longitudinal ridge of the base body 71.

Moreover, a mounting substrate 81 comprises a substrate 82, a feeding electrode 83 formed on a top surface of the substrate 82 and a ground conductor layer 84. The ground conductor layer 84 has a linear side edge 85 formed in a vicinity of the feeding electrode 83. Then, the surface-mount type antenna 70 according to the fourth embodiment of the invention is mounted on the mounting substrate 81, with the other principal surface d of the base body 71 arranged on the ground conductor layer 84-absent part of the top surface of the mounting substrate 81, with the longitudinal ridge of the base body 71 arranged parallel to the linear side edge 85 of the ground conductor layer 84, and with the feeding terminal 72 connected to the feeding electrode 83. Thereupon, an antenna apparatus 86 embodying the invention is realized.

That is, the surface-mount type antenna 70 according to the fourth embodiment of the invention shown in FIGS. 4A to 4G is similar in structure to the surface-mount type antenna 10 according to the first embodiment of the invention shown in FIGS. 1A to 1E, but the difference is that the radiating electrode 73 is routed from the one end side part 71*c* of one principal surface b to the other end side part 71*h* of the other principal surface d, and the radiating electrode terminating portion 74 is disposed on the other principal surface d.

Then, the surface-mount type antenna 70 according to the fourth embodiment of the invention thus constructed is mounted, with a distance of for example approximately 0.5 mm to 3 mm secured between the ridge of the base body 71 and the linear side edge 85 of the ground conductor layer 84. Simultaneously, the feeding terminal 72 is connected to the feeding electrode 83. Thereupon, the antenna apparatus 86 of the invention is operable at a frequency band of approximately 1 GHz to 10 GHz, for example.

The surface-mount type antennas respectively shown in FIGS. 2A to 2E, 3A to 3E and 4A to 4G are examples of the surface-mount type antennas according to the second to fourth embodiments of the invention. Here, the radiating electrode is not limited to the configurations illustrated in these examples, but may be of another configuration so long as it is routed from one end side part of one principal surface b, as a single conductor, to extend on any of one principal surface b; one side surface a; the other side surface c; the other principal surface d; and the other end face e, or extend over a combination of some of those surfaces. In this way, it is possible to ensure that the radiating electrode has a necessary length appropriate to the desired resonant frequency of the antenna.

In either case, it is important that the radiating electrode terminating portion be arranged parallel to the longitudinal ridge of the base body, so that the radiating electrode terminating portion and the linear side edge of the ground conductor layer are arranged substantially parallel to each other. In this way, as already explained, the resonant frequency of the antenna can be readily adjusted by making adjustment to the length of the radiating electrode terminating portion. In either case, it should be noted here that various changes and modifications are possible without departing from the scope of the invention.

Figure 5A:
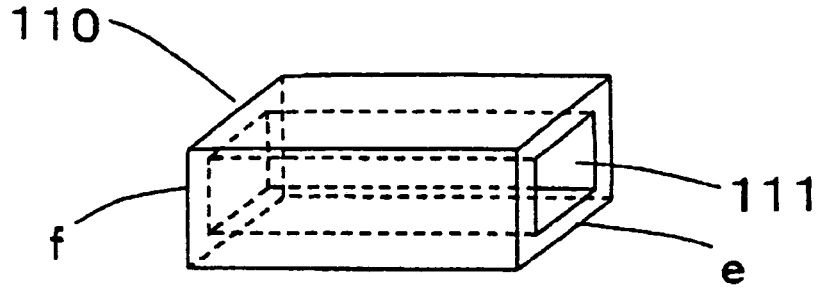
FIGS. 5A through 5E are perspective views each showing an example of the base-body configuration in a surface-mount type antenna according to a fifth embodiment of the invention, with FIGS. 5A to 5C indicating the case of forming a through hole, and FIGS. 5D and 5E indicating the case of forming a groove.
Figure 5B:
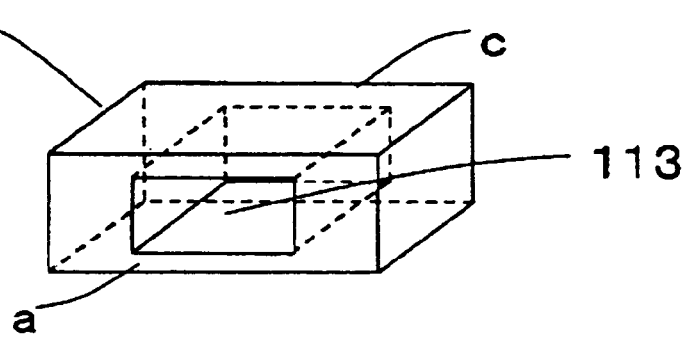
Figure 5C:
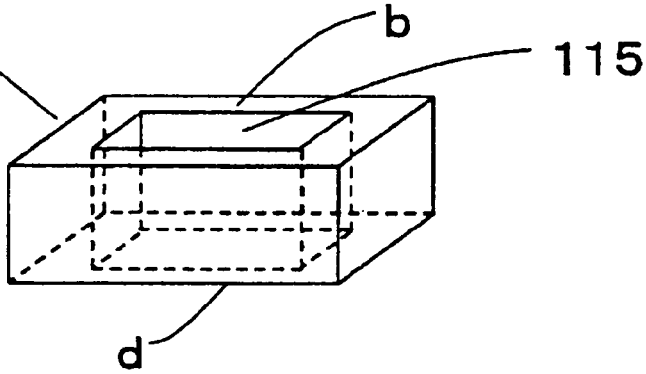
Figure 5D:
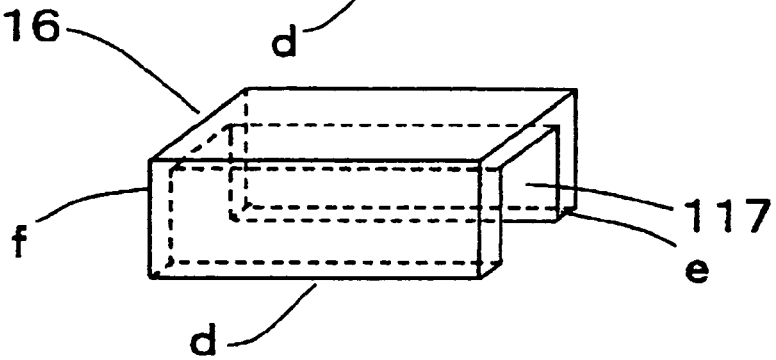
Figure 5E:
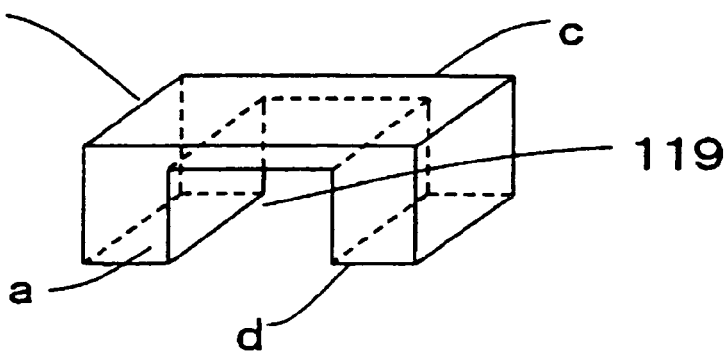

FIGS. 5A through 5E are perspective views each showing an example of the base-body configuration in a surface-mount type antenna according to a fifth embodiment of the invention. FIG. 5A shows a base body 110 having a through hole 111 drilled all the way through from one end face f to the other end face e. FIG. 5B shows a base body 112 having a through hole 113 drilled all the way through from one side surface a to the other side surface c. FIG. 5C shows a base body 114 having a through hole 115 drilled all the way through from one principal surface b to the other principal surface d. FIG. 5D shows a base body 116 having a groove 117 formed on the other principal surface d so as to penetrate all the way through from one end face f to the other end face e. FIG. 5E shows a base body 118 having a groove 119 formed on the other principal surface d so as to penetrate all the way through from one side surface a to the other side surface c.

By creating a through hole or a groove as illustrated in FIGS. 5A through 5E, the effective relative dielectric constant of the base body 110, 112, 114, 116, 118 can be decreased; wherefore the accumulation of electric field energy can be suppressed. This makes it possible to achieve a wider bandwidth in the surface-mount type antennas according to the first to fourth embodiments of the invention. Another advantage is that both the amount of the material used to form the base body and the weight of the construction can be reduced successfully.

The through hole or groove may have any given dimension and shape so long as it does not interfere with the radiating-electrode routing as shown in FIGS. 1A to 1E, 2A to 2E, 3A to 3E and 4A to 4G. Then, the base body 110, 112, 114, 116, 118 having such a through hole or a groove is provided with the feeding terminal, the radiating electrode, etc. as shown in FIGS. 1A to 1E, 2A to 2E, 3A to 3E and 4A to 4G, thus constituting the surface-mount type antenna according to the fifth embodiment of the invention.

Although, in any of FIGS. 5A through 5E, the base body includes a single through hole or groove, the through hole or groove may be provided in plural in the base body. Also in this case, the same effects as explained just above can be achieved. Moreover, in either case, it should be noted that various changes and modifications are possible without departing from the scope of the invention. For example, the through hole or groove may be so formed as to have a curved plane, or a polygonal shape.

Figure 6A:
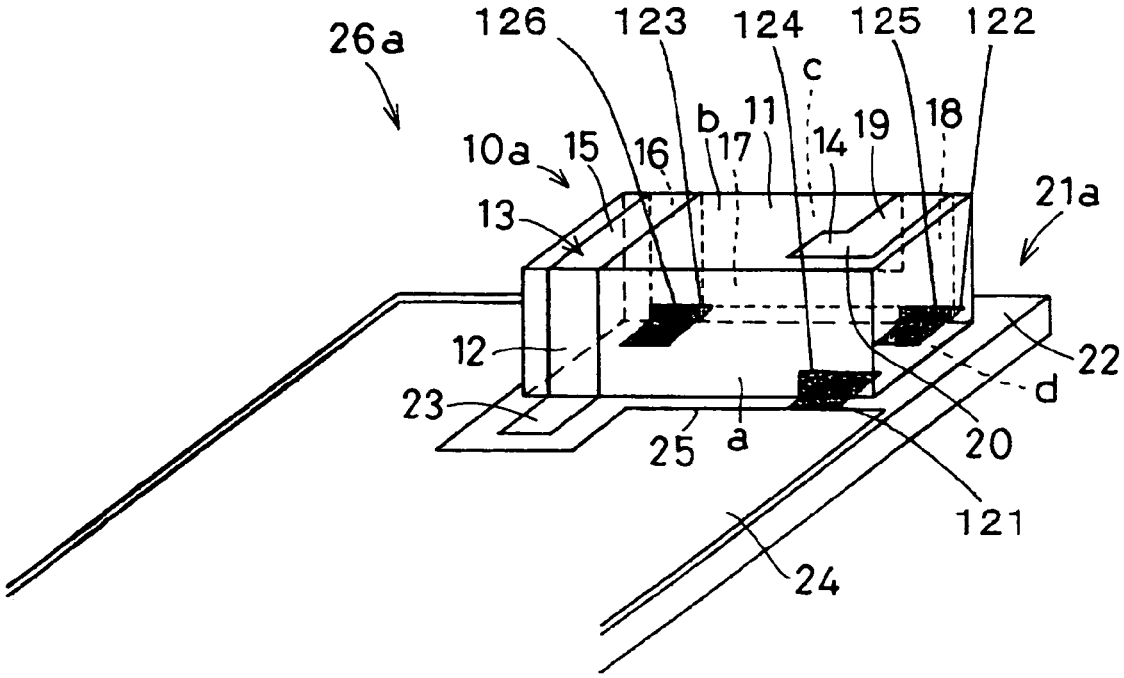
FIG. 6A is a perspective view showing a surface-mount type antenna according to a sixth embodiment of the invention, and also an antenna apparatus according to a fifth embodiment of the invention that is constituted by mounting the surface-mount type antenna on a top surface of a mounting substrate.
Figure 6B:
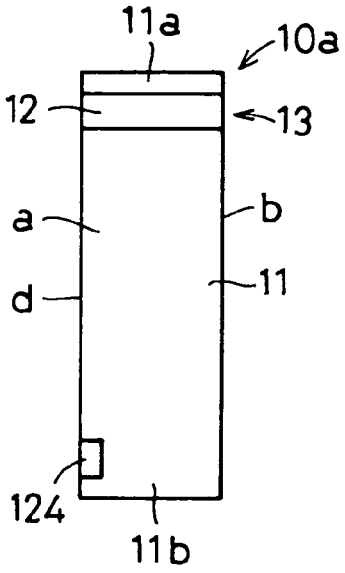
FIG. 6B is a view the surface-mount type antenna according to the sixth embodiment of the invention, viewed from one side surface side.
Figure 6C:
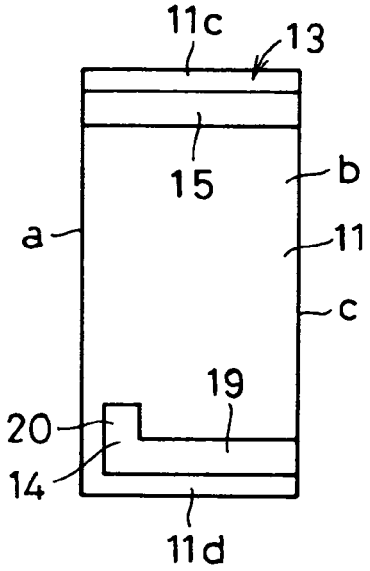
FIG. 6C is a view the surface-mount type antenna according to the sixth embodiment of the invention, viewed from one principal surface side.
Figure 6D:
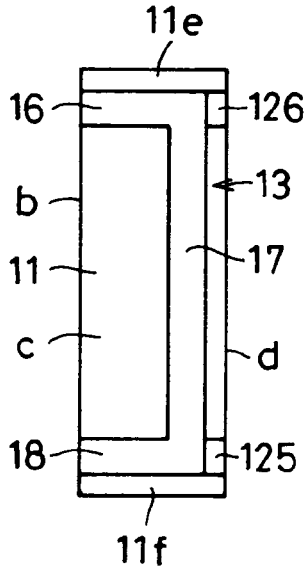
FIG. 6D is a view the surface-mount type antenna according to the sixth embodiment of the invention, viewed from another side surface side.
Figure 6E:
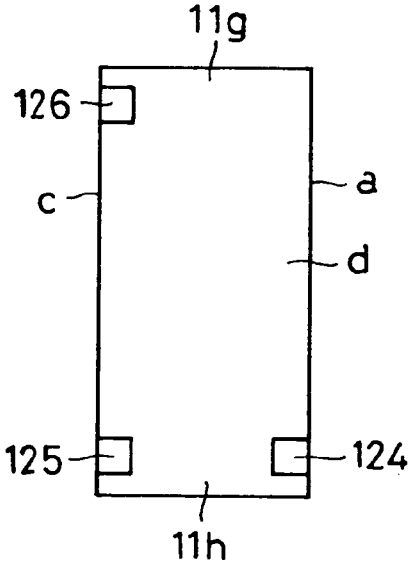
FIG. 6E is a view the surface-mount type antenna according to the sixth embodiment of the invention, viewed from another principal surface side.
Figure 6F:
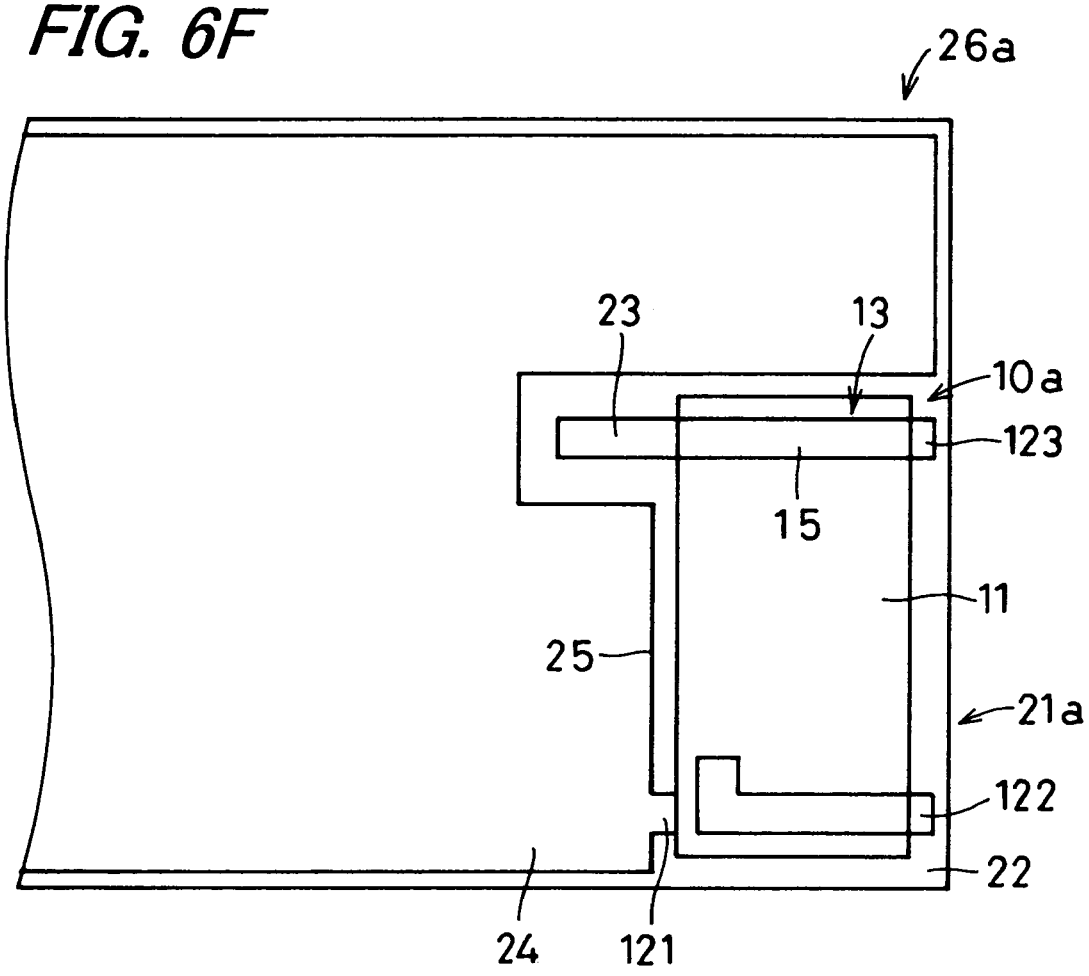
FIG. 6F is a plan view showing the surface-mount type antenna according to the sixth embodiment of the invention, and also the antenna apparatus according to the fifth embodiment of the invention that is constituted by mounting the surface-mount type antenna on a top surface of the mounting substrate.

FIG. 6A is a perspective view showing a surface-mount type antenna according to a sixth embodiment of the invention, and also an antenna apparatus according to a fifth embodiment of the invention that is constituted by mounting the surface-mount type antenna on a top surface of a mounting substrate; FIG. 6B is a view the surface-mount type antenna according to the sixth embodiment of the invention, viewed from one side surface side; FIG. 6C is a view the surface-mount type antenna according to the sixth embodiment of the invention, viewed from one principal surface side; FIG. 6D is a view the surface-mount type antenna according to the sixth embodiment of the invention, viewed from another side surface side; FIG. 6E is a view the surface-mount type antenna according to the sixth embodiment of the invention, viewed from another principal surface side; and FIG. 6F is a plan view showing the surface-mount type antenna according to the sixth embodiment of the invention, and also the antenna apparatus according to the fifth embodiment of the invention that is constituted by mounting the surface-mount type antenna on a top surface of the mounting substrate.

In an antenna apparatus 26*a* according to this embodiment of the invention, an auxiliary electrode for surface mounting (hereafter referred to as "a surface-mounting auxiliary electrode") 121, 122, and 123 is formed on a mounting substrate 21*a*. An auxiliary terminal for surface mounting (hereafter referred to as "a surface-mounting auxiliary terminal") 124, 125, and 126 is formed on the other principal surface d of the base body 11. Note that in FIGS. 6A to 6F, portions in common with FIGS. 1A to 1E are denoted by the same reference numerals.

By dint of the surface-mounting auxiliary electrode 121, 122, 123 and the surface-mounting auxiliary terminal 124, 125, 126, at the time of mounting a surface-mount type antenna 10*a* on the mounting substrate 21*a*, the surface-mount type antenna 10*a* of the invention can be firmly fixed by bonding using a solder such as a brazing filler material. This helps prevent the surface-mount type antenna 10*a* from undergoing positional deviation, and thus the desired antenna characteristics can be maintained satisfactorily.

In the alternative, the surface-mounting auxiliary terminal 124, 125, 126 may be so formed as to extend from the other principal surface d to the both side surface a and c of the base body, as shown in FIGS. 6A to 6F. In this case, since a solder fillet is created at the time of the bonding using a solder such as a brazing filler material, the securing of the surface-mount type antenna can be achieved more firmly. Moreover, the surface-mounting auxiliary electrode 121 located on the ground-conductor-layer 24 side may be so formed as to extend partly from the ground conductor layer 24 and electrically connected to the ground conductor layer 24.

However, in a case where the surface-mount type antenna 10*a* of the invention is placed, with the aid of the surface-mounting auxiliary terminal 124, on the surface-mounting auxiliary electrode 121 electrically connected to the ground conductor layer, the proportion of variation in the resonant frequency per unit length of the radiating electrode is undesirably increased at the time of making resonant-frequency adjustment in the antenna. This may lead to degradation in the resonant-frequency adjustability. In this case, an appropriately sized gap should be created between the ground conductor layer 24 and the surface-mounting auxiliary electrode 124 so that no electrical connection is established therebetween.

Figure 7A:
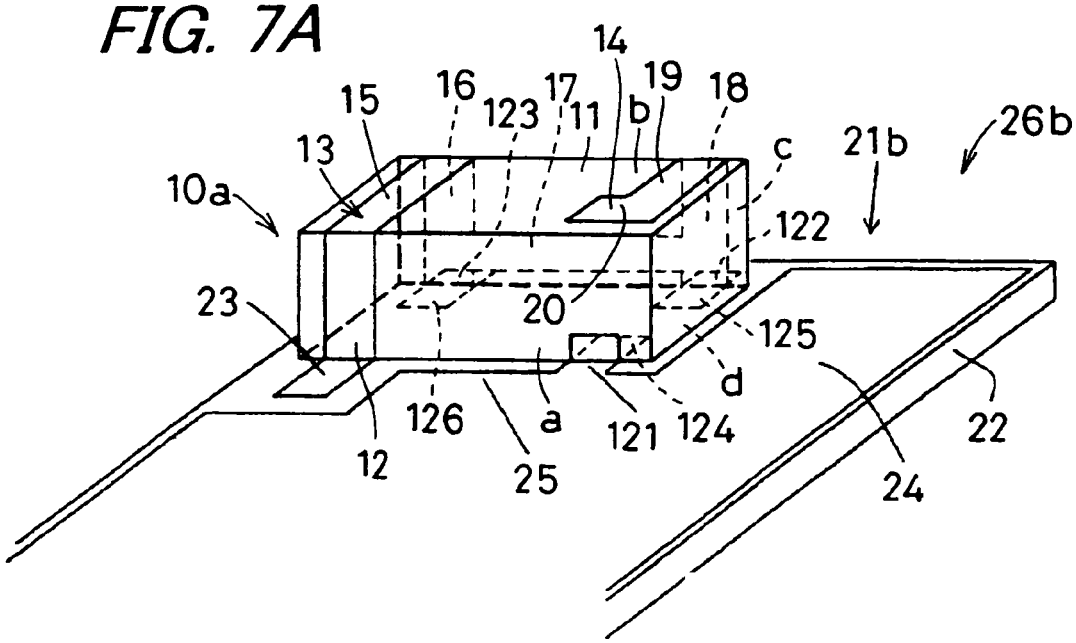
FIG. 7A is a perspective view showing an antenna apparatus according to a sixth embodiment of the invention that is constituted by mounting the surface-mount type antenna according to the sixth embodiment of the invention on a top surface of a mounting substrate.
Figure 7B:
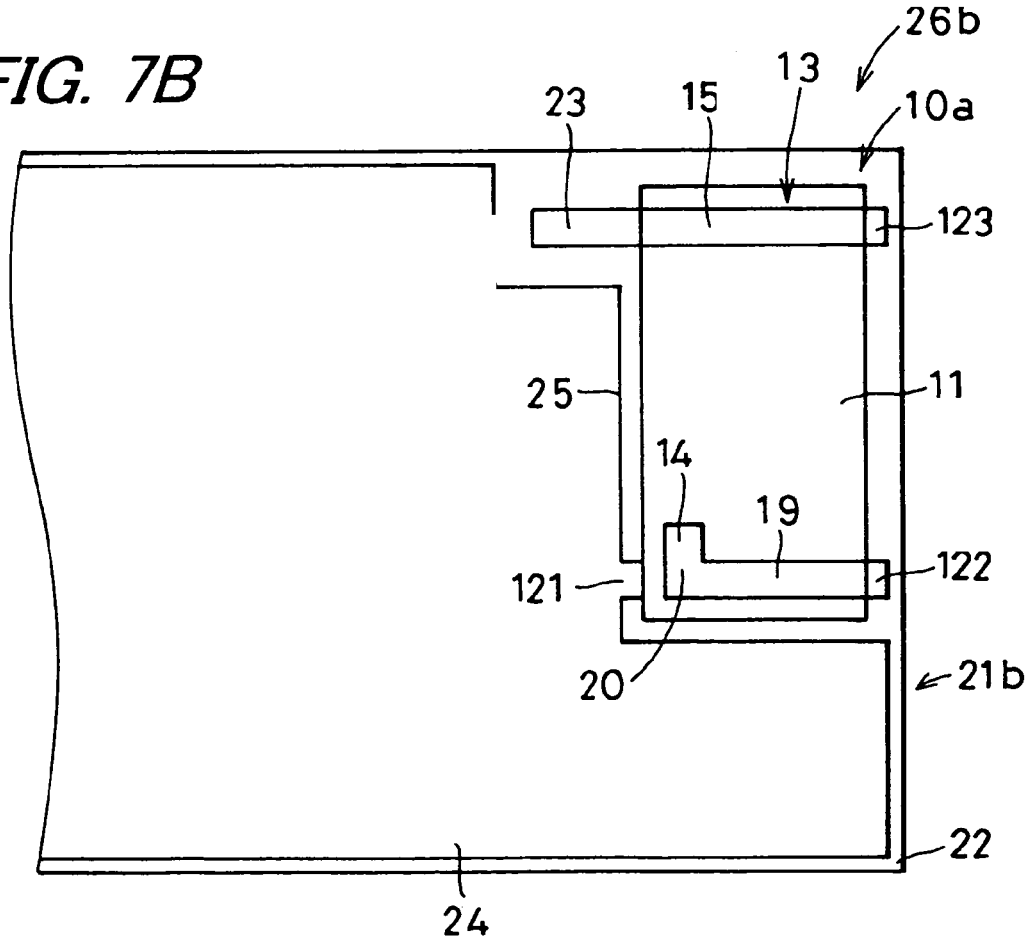
FIG. 7B is a plan view showing the antenna apparatus according to the sixth embodiment of the invention that is constituted by mounting the surface-mount type antenna according to the sixth embodiment of the invention on the top surface of the mounting substrate.

FIG. 7A is a perspective view showing an antenna apparatus according to a sixth embodiment of the invention that is constituted by mounting the surface-mount type antenna according to the sixth embodiment of the invention on a top surface of a mounting substrate; and FIG. 7B is a plan view showing the antenna apparatus according to the sixth embodiment of the invention that is constituted by mounting the surface-mount type antenna according to the sixth embodiment of the invention on the top surface of the mounting substrate.

In this embodiment, the same components as those of the aforementioned embodiment will be denoted by the same reference numerals, and it will be omitted to describe in detail. An antenna apparatus 26*b* of this embodiment has a structure that the antenna 10*a* is disposed at a left rear in FIG. 7A (an upper right in FIG. 7B) of a mounting substrate 21*b*. Also in this construction, the radiating electrode terminating portion 14 and the linear side edge 25 of the ground conductor layer 24 are arranged substantially parallel to each other. Thus, since the sensitivity in the change of the antenna resonant frequency to the length adjustment for the radiating electrode terminating portion 14 is lowered, allowance can be made for the range of adjustment to the length of the radiating electrode terminating portion 14. This helps facilitate the resonant-frequency adjustment in the antenna.

Figure 8A:
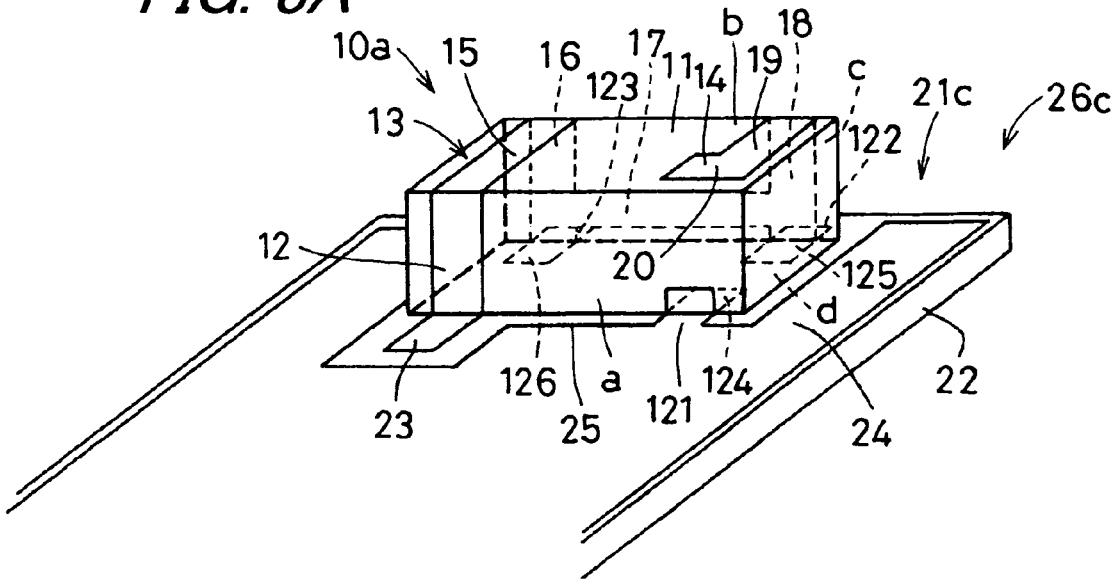
FIG. 8A is a perspective view showing an antenna apparatus according to a seventh embodiment of the invention that is constituted by mounting the surface-mount type antenna according to the sixth embodiment of the invention on the top surface of a mounting substrate.
Figure 8B:
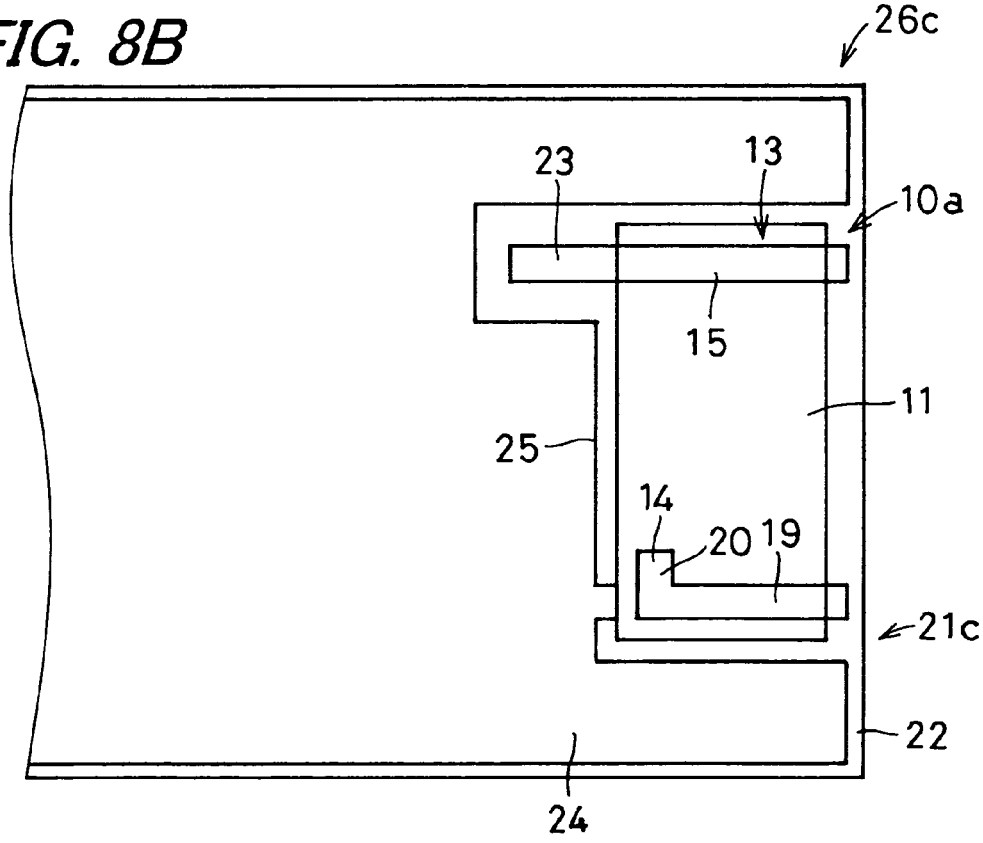
FIG. 8B is a plan view showing the antenna apparatus according to the seventh embodiment of the invention that is constituted by mounting the surface-mount type antenna according to the sixth embodiment of the invention on the top surface of the mounting substrate.

FIG. 8A is a perspective view showing an antenna apparatus according to a seventh embodiment of the invention that is constituted by mounting the surface-mount type antenna according to the sixth embodiment of the invention on the top surface of a mounting substrate; and FIG. 8B is a plan view showing the antenna apparatus according to the seventh embodiment of the invention that is constituted by mounting the surface-mount type antenna according to the sixth embodiment of the invention on the top surface of the mounting substrate.

In this embodiment, the same components as those of the aforementioned embodiment will be denoted by the same reference numerals, and it will be omitted to describe in detail. An antenna apparatus 26*c* of this embodiment has a structure that the antenna 10*a* is disposed at a central rear in FIG. 8A (a central right in FIG. 8B) of a mounting substrate 21*c*.

By disposing the antenna at the central rear of the mounting substrate as shown in FIG. 8A, the radiating electrode terminating portion 14 and the linear side edge 25 of the ground conductor layer 24 are arranged substantially parallel to each other. Thus, since the sensitivity in the change of the antenna resonant frequency to the length adjustment for the radiating electrode terminating portion 14 is lowered, allowance can be made for the range of adjustment to the length of the radiating electrode terminating portion 14. This helps facilitate the resonant-frequency adjustment in the antenna.

Figure 9A:
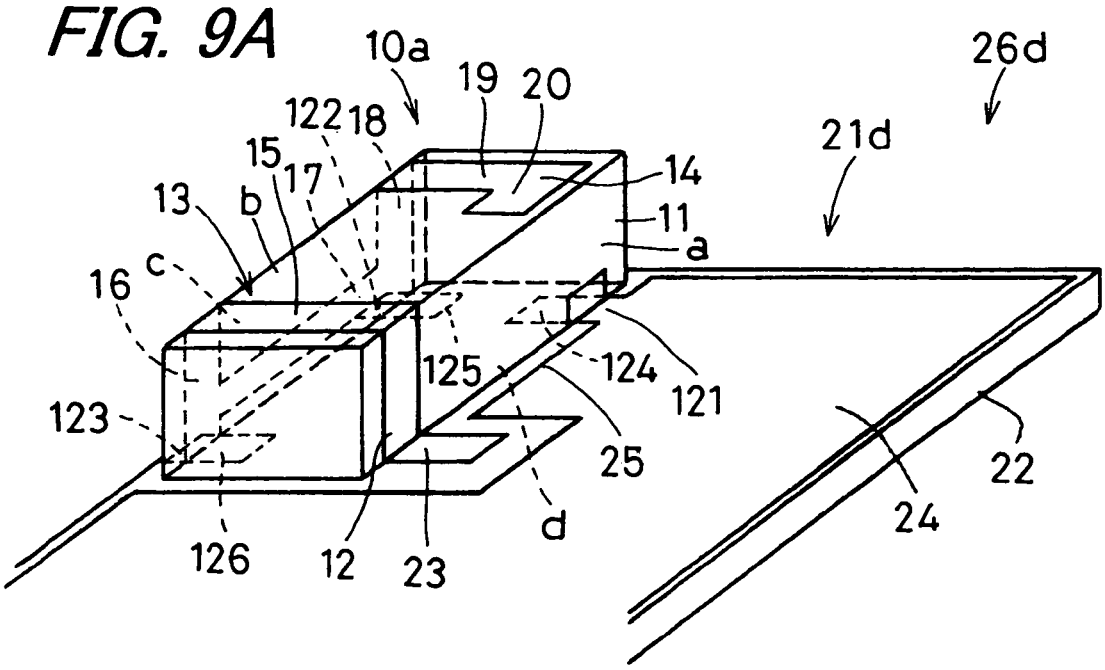
FIG. 9A is a perspective view showing an antenna apparatus according to an eighth embodiment of the invention that is constituted by mounting the surface-mount type antenna according to the sixth embodiment of the invention on a top surface of a mounting substrate.
Figure 9B:
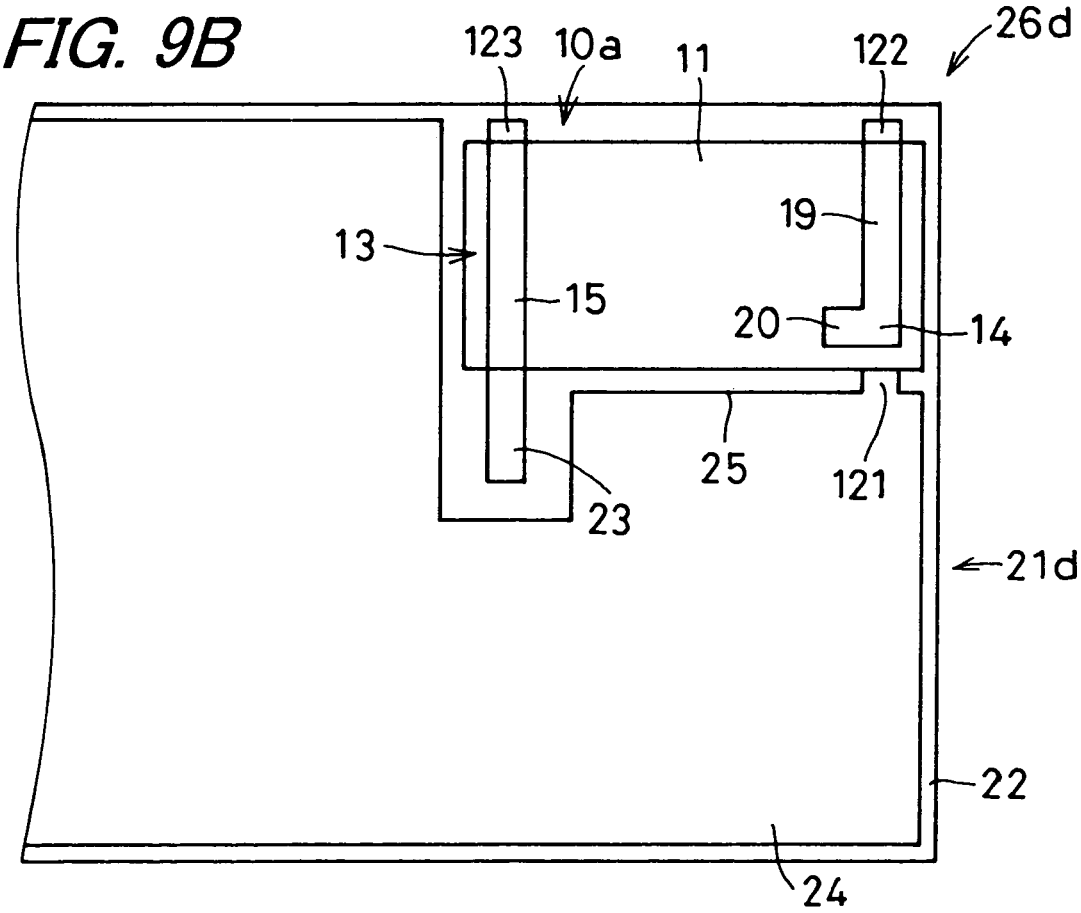
FIG. 9B is a plan view showing the antenna apparatus according to the eighth embodiment of the invention that is constituted by mounting the surface-mount type antenna according to the sixth embodiment of the invention on the top surface of the mounting substrate.

FIG. 9A is a perspective view showing an antenna apparatus according to an eighth embodiment of the invention that is constituted by mounting the surface-mount type antenna according to the sixth embodiment of the invention on a top surface of a mounting substrate; and FIG. 9B is a plan view showing the antenna apparatus according to the eighth embodiment of the invention that is constituted by mounting the surface-mount type antenna according to the sixth embodiment of the invention on the top surface of the mounting substrate.

In this embodiment, the same components as those of the aforementioned embodiment will be denoted by the same reference numerals, and it will be omitted to describe in detail. An antenna apparatus 26*d* of this embodiment has a structure that the surface-mount type antenna 10*a* is arranged in a vertical position along the longitudinal direction of a mounting substrate 21*d* and is disposed at a left rear in FIG. 9A (an upper right in FIG. 9B) of the mounting substrate 21*d*.

In any of the constructions described thus far, the radiating electrode terminating portion 14 and the linear side edge 25 of the ground conductor layer 24 are arranged substantially parallel to each other. Thus, since the sensitivity in the change of the antenna resonant frequency to the length adjustment for the radiating electrode terminating portion 14 is lowered, allowance can be made for the range of adjustment to the length of the radiating electrode terminating portion 14. This helps facilitate the resonant-frequency adjustment in the antenna.

It is to be understood that the application of the invention is not limited to the specific embodiments described heretofore, and that many modifications and variations of the invention are possible within the scope of the invention.

In any of the surface-mount type antennas 10, 10*a*, 30, 50 and 70 according to the first to sixth embodiments of the invention, the base body 11, 31, 51, 71, 110, 112, 114, 116 and 118 is made of a substantially rectangular parallelepiped dielectric or magnetic material. For example, there is prepared a dielectric material which is predominantly composed of alumina (relative dielectric constant: 9.6). The dielectric material in powder form is subjected to pressure-molding and firing to obtain ceramics. Using the ceramics, the base body is fabricated. In the alternative, the base body 11, 31, 51, 71, 110, 112, 114, 116 and 118 may be composed of a composite material made of ceramics, i.e. a dielectric material and resin, or composed of a magnetic material such as ferrite.

In a case where the base body 11, 31, 51, 71, 110, 112, 114, 116 and 118 is composed of a dielectric material, a high frequency signal propagates through the radiating electrode at a lower speed, resulting in the wavelength becoming shorter. Where the relative dielectric constant of the base body 11, 31, 51, 71, 110, 112, 114, 116 and 118 is expressed as $\epsilon r$, the effective length of the conductor pattern of the radiating electrode is reduced to a value: $(1/\epsilon r)^{1/2}$. Hence, the pattern length being equal, as the relative dielectric constant of the base body 11, 31, 51, 71, 110, 112, 114, 116 and 118 is increased, the current distribution region becomes larger and larger in the radiating electrode portion. This allows the radiating electrode to emit a larger quantity of radio waves, resulting in an advantage in enhancing the gain of the antenna.

Meanwhile, in the case of attaining the same antenna characteristics as conventional ones, the pattern length of the radiating electrode can be given as $(1/\epsilon r)^{1/2}$, thus achieving compactness in the surface-mount type antennas 10, 10*a*, 30, 50 and 70 according to the first to sixth embodiments of the invention.

Note that fabricating the base body 11, 31, 51, 71, 110, 112, 114, 116 and 118 using a dielectric material poses the following tendencies. If the value $\epsilon r$ is less than 3, it approaches the relative dielectric constant as observed in the air ($\epsilon r=1$). This makes it difficult to meet the demand of the market for antenna miniaturization. By contrast, if the value $\epsilon r$ exceeds 30, although miniaturization can be achieved, since the gain and the bandwidth of the antenna are proportional to the size of the antenna, the gain and the bandwidth of the antenna become unduly small. As a result, the antenna fails to offer satisfactory antenna characteristics. Hence, in the case of fabricating the base body 11, 31, 51, 71, 110, 112, 114, 116 and 118 using a dielectric material, it is preferable to use a dielectric material having a relative dielectric constant $\epsilon r$ which is kept within a range from 3 to 30. The preferred examples of such a dielectric material include ceramic materials typified by alumina ceramics, zirconia ceramics, etc; and resin materials typified by tetrafluoroethylene, glass epoxy, etc.

On the other hand, in the case of fabricating the base body 11, 31, 51, 71, 110, 112, 114, 116 and 118 using a magnetic material, the radiating electrode has a higher impedance. Thus, the Q factor of the antenna is lowered, and correspondingly the bandwidth can be increased.

Fabricating the base body 11, 31, 51, 71, 110, 112, 114, 116 and 118 using a magnetic material poses the following tendency. If the relative magnetic permeability $\mu r$ exceeds 8, although a wider bandwidth can be achieved in the antenna, since the gain and the bandwidth of the antenna are proportional to the size of the antenna, the gain and the bandwidth of the antenna become unduly small. As a result, the antenna fails to offer satisfactory antenna characteristics. Hence, in the case of fabricating the base body 11, 31, 51, 71, 110, 112, 114, 116 and 118 using a magnetic material, it is preferable to use a magnetic material having a relative magnetic permeability μr which is kept within a range from 1 to 8. The preferred examples of such a magnetic material include YIG (Yttria Iron Garnet), Ni—Zr compound, and Ni—Co—Fe compound.

The radiating electrode 13, 33, 53 and 73, the feeding terminal 12, 32, 52 and 72, and the surface-mounting auxiliary terminal 124, 125 and 126 are each made of, for example, a metal material which is predominantly composed of any of aluminum, copper, nickel, silver, palladium, platinum, and gold. In order to form various patterns using the aforementioned metal materials, conductor layers having desired pattern configurations are formed on the surface of the base body 11, 31, 51, 71, 110, 112, 114, 116 and 118 by a conventionally-known printing method, a thin-film forming technique based on a vapor-deposition method, a sputtering method, etc., a metal foil bonding method, a plating method, or the like method.

As the substrate 22, 42, 63 and 82 constituting the mounting substrate 21, 21*a*, 21*b*, 21*c*, 21*d*, 41, 62 and 81, an ordinary circuit substrate such as a glass epoxy substrate, an alumina ceramics substrate, or a glass ceramics substrate is employed.

Moreover, the feeding electrode 23, 43, 64 and 83 and the ground conductor layer 24, 44, 65 and 84 are each made of, for example, a metal material which is predominantly composed of any of aluminum, copper, nickel, silver, palladium, platinum, and gold.

On the top surface of the mounting substrate 21, 21*a*, 21*b*, 21*c*, 21*d*, 41, 62 and 81, the ground conductor layer 24, 44, 65 and 84 has the linear side edge 25, 45, 66 and 85 located in the vicinity of the feeding electrode 23, 43, 64 and 83. Then, the base body 11, 31, 51, 71, 110, 112, 114, 116 and 118 is preferably mounted, with its other principal surface d arranged on the top surface of the mounting substrate 21, 21*a*, 21*b*, 21*c*, 21*d*, 41, 62 and 81, and with its longitudinal ridge arranged parallel to the linear side edge 25, 45, 66 and 85 of the ground conductor layer 24, 44, 65 and 84. Besides, the base body is preferably mounted on the mounting substrate at a distance of approximately 0.5 mm to 3 mm from the end of the ground conductor layer 24, 44, 65 and 84. Such an arrangement is desirable in terms of enhancement of the bandwidth and gain of the antenna.

(Practical Example)

Next, a description will be given below as to practical examples of the surface-mount type antenna and the antenna apparatus embodying the invention.

There were built a prototype of the first surface-mount type antenna 10, 30 and 50 of the invention shown in FIGS. 1A to 1E, 2A to 2E and 3A to 3E and also, for comparison purposes, a prototype of the conventional surface-mount type antenna 200 shown in FIG. 10. Firstly, an alumina-made base body (dimension: 10 mm×4 mm×3 mm) is prepared. Then, 1 mm-wide conductor patterns of different configurations are formed, using silver conductors, to realize four pieces of radiating electrodes respectively shown in FIGS. 1A to 1E, 2A to 2E, 3A to 3E and 10. Each of the radiating electrodes is formed on the base body. As the mounting substrate 21, 41, 62 and 210, a 0.8 mm-thick glass epoxy substrate is used. The ground conductor layer 24, 44, 65 and 209 is 40 mm in breadth and 80 mm in length. That part of the ground conductor layer which faces the surface-mount type antenna and the feeding electrode 23, 43 and 64 is cut out. Here, in each of the surface-mount type antennas shown in FIGS. 1A to 1E, 2A to 2E, 3A to 3E and 10, the radiating electrode terminating portion of the radiating electrode is subjected to trimming, and simultaneously the resonant frequency of each of the four antenna apparatuses is measured to work out the amount of variation in the resonant frequency per unit length of the trimmed radiating electrode terminating portion.

The same experiment was conducted on the construction shown in FIGS. 6A to 6F in which the surface-mounting auxiliary terminal 124 disposed on the other principal surface d of the base body 11 of the surface-mount type antenna 10*a* is connected to the surface-mounting auxiliary electrode 121, disposed on the mounting substrate 21*a*, that is electrically connected to the ground conductor layer 24 (GND connection).

Listed in FIG. 11 are the experimental results. In FIG. 11, Numeral 1 (Experimental result 1) corresponds to the result of the experiment conducted on the conventional surface-mount type antenna. Numerals 2 to 4 (Experimental results 2 to 4) correspond to the results of the experiments conducted on the surface-mount type antennas having the radiating-electrode patterns shown in FIGS. 1A to 1E, 2A to 2E and 3A to 3E, respectively. Regarding the "radiating electrode arrangement" shown in FIG. 11, the radiating-electrode patterns as shown in FIGS. 10 as well as FIGS. 1A to 1E, 2A to 2E and 3A to 3E are each depicted in plan configuration. The arrows in the figure each indicate the direction in which the length of the radiating electrode terminating portion is adjusted. Moreover, the "GND disconnection" refers to the construction shown in FIGS. 6A to 6F in which the surface-mounting auxiliary terminal 124 is connected to the surface-mounting auxiliary electrode 121, disposed on the mounting substrate 21*a*, that is electrically disconnected from the ground conductor layer 24, with a gap secured therebetween. On the other hand, the "GND connection" refers to the construction in which the surface-mounting auxiliary terminal is connected to the surface-mounting auxiliary electrode 121 electrically connected to the ground conductor layer 24.

Experimental result 1 (GND disconnection) corresponds to the conventional surface-mount type antenna, whereas Experimental results 2, 3 and 4 (GND disconnection) correspond to the surface-mount type antennas according to the first to third embodiments of the invention. As seen from these results, the amount of variation in the resonant frequency per unit length of the trimmed radiating electrode terminating portion as observed in the conventional construction (19.1 MHz/mm) is greater than the amount of variation in the resonant frequency per unit length of the trimmed radiating electrode terminating portion as observed in the construction embodying the invention (13.0 to 9.5 MHz/mm). That is, according to the surface-mount type antenna of the invention, when the resonant frequency of the antenna is adjusted by subjecting the radiating electrode terminating portion to trimming, variation in the resonant frequency of the antenna is not as significant as the conventional surface-mount type antenna. Hence, it has been confirmed that the resonant frequency of the antenna can be adjusted with ease by subjecting the radiating electrode terminating portion to trimming.

Similarly, there are shown the experimental results concerning the construction shown in FIGS. 6A to 6F in which the surface-mounting auxiliary terminal 124 disposed on the other principal surface d of the base body 11 of the surface-mount type antenna 10*a* is connected to the surface-mounting auxiliary electrode 121 disposed on the mounting substrate 21*a* (GND connection). Experimental result 1 (GND connection) corresponds to the conventional surface-mount type antenna, whereas Experimental results 2, 3 and 4 (GND connection) correspond to the surface-mount type antennas according to the first to third embodiments of the invention. Also in this case, the amount of variation in the resonant frequency per unit length of the trimmed open end of the radiating electrode as observed in the conventional construction (36.4 MHz/mm) is greater than the amount of variation in the resonant frequency per unit length of the trimmed open end of the radiating electrode as observed in the construction embodying the invention (23.7 to 16.5 MHz/mm). That is, according to the surface-mount type antenna of the invention, although the variation condition compares unfavorably with that of the GND disconnection, variation in the resonant frequency of the antenna resulting from trimming of the radiating electrode terminating portion is not as significant as the conventional surface-mount type antenna. Hence, it has been confirmed that the resonant frequency of the antenna can be adjusted with ease by subjecting the radiating electrode terminating portion to trimming.

It is to be understood that the application of the invention is not limited to the specific embodiments described heretofore, and that many modifications and variations of the invention are possible within the scope of the invention.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A surface-mount type antenna comprising:

a base body made of a rectangular parallelepiped dielectric or magnetic material, the base body including two opposed side surfaces, two opposed principal surfaces, anal two opposed end faces, the four surfaces each having a first end side part on the same end side part of each surface and a second end side part opposite the first end side part, a first end face on the first end side part of the base body and a second end face on the second end side part of the base body;

a feeding terminal formed at one end of one side surface of the base body; and a radiating electrode, wherein one end of the radiating electrode is connected to the feeding terminal, and wherein the other end of the radiating electrode is routed from a first end side part of a first side surface, through a first end side part of a first principal surface of the base body, through a first end side part of the second side surface, and thereafter along a route selected from the group consisting of:

(1) to a second end side part of the second side surface through the second end side part of the second side surface and to the second end side part of the first principal surface, (2) to a second end side part of the second side surface, through the second end side part of the second side surface, through a second end side part of the first principal surface and further to a second end side part of the first side surface, and (3) to a second end side part of the second side surface, through the second end face on the second end side part and then to a second end side part of a second principal surface, and wherein the radiating electrode further extends from the second end side part selected from the group consisting of the second end side part of the first principal surface, the second end side part of the first side surface, and the second end side part of the second principal surface to the first end side part so as to be parallel to a ridge of the base body, and wherein a radiating electrode terminating portion which is the other end of the radiating electrode, is formed as an open end, and the radiating electrode terminating portion is further formed to be short so as to fail to reach the first end side part.

2. The surface-mount type antenna of claim 1, wherein a through hole or a groove is formed in the base body made of a rectangular parallelepiped dielectric or magnetic material, the through hole being drilled all the way through from the first side surface to the second side surface, or from one end face to another end face, or from the first principal surface to the the second principal surface of the base body, and the groove being formed on the second principal surface of the base body so as to penetrate all the way through from one end face to the other end face, from one side surface to the other side surface or from the first principal surface to the second principal surface.

3. The surface-mount type antenna of claim 1, wherein an auxiliary terminal for surface mounting is formed on the second principal surface of the base body.

4. The surface-mount type antenna of claim 2, wherein an auxiliary terminal for surface mounting is formed on the second principal surface of the base body.

5. The surface-mount type antenna of claim 1, wherein the rectangular parallelepiped base body is chamfered at its corner and ridge to produce a curved or flat chamfer.

6. The surface-mount type antenna of claim 1, wherein the base body is made of a dielectric material having a relative dielectric constant $\epsilon r$ which is kept within a range from 3 to 30.

7. The surface-mount type antenna of claim 1, wherein the base body is made of a magnetic material having a relative magnetic permeability $\mu r$ which is kept within a range from 1 to 8.

8. An antenna apparatus comprising:

a mounting substrate having formed thereon a feeding electrode and a ground conductor layer with a linear side edge located in a vicinity of the feeding electrode; and the surface-mount type antenna of claim 1, wherein the antenna apparatus is constructed by mounting the surface-mount type antenna on the mounting substrate, with the second principal surface of the base body arranged on a top surface of the mounting substrate, with the ridge of the base body arranged parallel to the linear side edge of the ground conductor layer, and with the feeding terminal connected to the feeding electrode.

9. An antenna apparatus comprising:

a mounting substrate having formed thereon a feeding electrode and a ground conductor layer with a linear side edge located in a vicinity of the feeding electrode; and the surface-mount type antenna of claim 2, wherein the antenna apparatus is constructed by mounting the surface-mount type antenna on the mounting substrate, with the second principal surface of the base body arranged on a top surface of the mounting substrate, with the ridge of the base body arranged parallel to the linear side edge of the ground conductor layer, and with the feeding terminal connected to the feeding electrode.

10. An antenna apparatus comprising:

a mounting substrate having formed thereon a feeding electrode and a ground conductor layer with a linear side edge located in a vicinity of the feeding electrode; and the surface-mount type antenna of claim 3, wherein the antenna apparatus is constructed by mounting the surface-mount type antenna on the mounting substrate, with the second principal surface of the base body arranged on a top surface of the mounting substrate, with the ridge of the base body arranged parallel to the linear side edge of the ground conductor layer, and with the feeding terminal connected to the feeding electrode.

11. An antenna apparatus comprising:

a mounting substrate having formed thereon a feeding electrode and a ground conductor layer with a linear side edge located in a vicinity of the feeding electrode; and the surface-mount type antenna of claim 4, wherein the antenna apparatus is constructed by mounting the surface-mount type antenna on the mounting substrate, with the second principal surface of the base body ranged on a top surface of the mounting substrate, with the ridge of the base body arranged parallel to the linear side edge of the ground conductor layer, and with the feeding terminal connected to the feeding electrode.

* * * * *